US011252999B2

(12) United States Patent
Lee et al.

(10) Patent No.: US 11,252,999 B2
(45) Date of Patent: Feb. 22, 2022

(54) AEROSOL GENERATING DEVICE

(71) Applicant: KT&G CORPORATION, Daejeon (KR)

(72) Inventors: Jong Sub Lee, Seongnam-si (KR); Dae Nam Han, Daejeon (KR); Jang Uk Lee, Seoul (KR); Jung Ho Han, Daejeon (KR); Hun Il Lim, Seoul (KR); Jin Young Yoon, Seoul (KR); Young Lea Kim, Seoul (KR); Ji Soo Jang, Seoul (KR); Wang Seop Lim, Anyang-si (KR); Moon Bong Lee, Seoul (KR); Soung Ho Ju, Daejeon (KR); Du Jin Park, Seoul (KR); Seong Won Yoon, Yongin-si (KR)

(73) Assignee: KT&G CORPORATION, Daejeon (KR)

( * ) Notice: Subject to any disclaimer, the term of this patent is extended or adjusted under 35 U.S.C. 154(b) by 0 days.

(21) Appl. No.: 16/604,437

(22) PCT Filed: Apr. 10, 2018

(86) PCT No.: PCT/KR2018/004178
§ 371 (c)(1),
(2) Date: Oct. 10, 2019

(87) PCT Pub. No.: WO2018/190605
PCT Pub. Date: Oct. 18, 2018

(65) Prior Publication Data

US 2020/0170298 A1 Jun. 4, 2020

(30) Foreign Application Priority Data

Apr. 11, 2017 (KR) ..... 10-2017-0046938
Jun. 19, 2017 (KR) ..... 10-2017-0077586
Jul. 3, 2017 (KR) ..... 10-2017-0084390

(51) Int. Cl.
*A24F 40/20* (2020.01)
*A24F 40/46* (2020.01)
*A24F 40/50* (2020.01)

(52) U.S. Cl.
CPC ..... *A24F 40/20* (2020.01); *A24F 40/46* (2020.01); *A24F 40/50* (2020.01)

(58) Field of Classification Search
CPC ..... A24F 40/20
See application file for complete search history.

(56) References Cited

U.S. PATENT DOCUMENTS 2,638,904 A 5/1953 Mitchell
4,637,407 A 1/1987 Bonanno et al.
(Continued)

FOREIGN PATENT DOCUMENTS

CA 2 973 143 A1 8/2016
CH 310239 A 12/1955
(Continued)

OTHER PUBLICATIONS

Office Action dated Dec. 11, 2019 in Korean Application No. 10-2018-0010836.
(Continued)

*Primary Examiner* — James Harvey
(74) *Attorney, Agent, or Firm* — Sughrue Mion, PLLC

(57) ABSTRACT

An aerosol generating device includes: a case; a container mounted inside the case to be movable in a longitudinal direction of the case and having an accommodating space configured to accommodate a cigarette; a heater disposed inside the case such that a front end thereof is inserted into the accommodating space of the container, the heater being configured to heat the cigarette when electricity is applied thereto; and an elastic support portion configured to elastically support the container with respect to the case.

10 Claims, 22 Drawing Sheets

(56) References Cited

U.S. PATENT DOCUMENTS 5,144,962 A 9/1992 Counts et al.
5,240,012 A 8/1993 Ehrman et al.
5,249,586 A 10/1993 Morgan et al.
5,388,594 A 2/1995 Counts et al.
5,465,738 A 11/1995 Rowland
5,479,948 A 1/1996 Counts et al.
5,591,368 A 1/1997 Fleischhauer et al.
5,666,977 A 9/1997 Higgins et al.
5,878,752 A 3/1999 Adams et al.
6,053,176 A 4/2000 Adams et al.
6,418,938 B1 7/2002 Fleischhauer et al.
6,532,965 B1 3/2003 Abhulimen et al.
6,615,840 B1 9/2003 Fournier et al.
6,810,883 B2 11/2004 Felter et al.
7,861,726 B1 1/2011 Lukasavitz
8,375,959 B2 2/2013 Dittrich et al.
8,419,085 B2 4/2013 Kim et al.
8,752,545 B2 6/2014 Buchberger
8,851,081 B2 10/2014 Fernando et al.
8,973,587 B2 3/2015 Liu
9,078,472 B2 7/2015 Liu
9,078,473 B2 7/2015 Worm et al.
9,271,528 B2 3/2016 Liu
9,320,299 B2 4/2016 Hearn et al.
9,423,152 B2 8/2016 Ampolini et al.
9,427,023 B2 8/2016 Liu
9,497,991 B2 11/2016 Besso et al.
9,499,332 B2 11/2016 Fernando et al.
9,516,899 B2 12/2016 Plojoux et al.
9,560,883 B2 2/2017 Hawes
9,603,388 B2 3/2017 Fernando et al.
9,655,383 B2 5/2017 Holzherr et al.
9,693,587 B2 7/2017 Plojoux et al.
9,723,871 B2 8/2017 Xiang
9,814,263 B2 11/2017 Cochand et al.
9,854,841 B2 1/2018 Ampolini et al.
9,854,845 B2 1/2018 Plojoux et al.
9,894,934 B2 2/2018 Li et al.
9,918,494 B2 3/2018 Mironov et al.
9,955,724 B2 5/2018 Lord
9,986,760 B2 6/2018 Macko et al.
9,999,247 B2 6/2018 Ruscio et al.
10,015,990 B2 7/2018 Mironov
10,031,183 B2 7/2018 Novak, III et al.
10,070,667 B2 9/2018 Lord et al.
10,104,911 B2 10/2018 Thorens et al.
10,130,780 B2 11/2018 Talon
10,136,673 B2 11/2018 Mironov
10,159,283 B2 12/2018 Mironov
10,194,697 B2 2/2019 Fernando et al.
10,299,513 B2 5/2019 Perez et al.
10,368,584 B2 8/2019 Fernando et al.
10,439,419 B2 10/2019 Bernauer et al.
10,440,987 B2 10/2019 Zeng et al.
10,448,670 B2 10/2019 Talon et al.
10,492,542 B1 12/2019 Worm et al.
10,548,350 B2 2/2020 Greim et al.
10,555,553 B2 2/2020 Binassi et al.
10,588,351 B2 3/2020 Ricketts
10,645,971 B2 5/2020 Zitzke
10,668,058 B2 6/2020 Rose et al.
10,716,329 B2 7/2020 Matsumoto et al.
10,813,174 B2 10/2020 Schneider et al.
10,881,143 B2 1/2021 Suzuki et al.
11,039,642 B2 6/2021 Zuber et al.
11,147,316 B2 10/2021 Farine et al.
2004/0261802 A1 12/2004 Griffin et al.
2005/0045198 A1 3/2005 Larson et al.
2005/0172976 A1 8/2005 Newman et al.
2008/0001052 A1 1/2008 Kalous et al.
2010/0307518 A1 12/2010 Wang
2011/0155151 A1 6/2011 Newman et al.
2011/0209717 A1 9/2011 Han
2011/0290248 A1 12/2011 Schennum
2011/0290269 A1 12/2011 Shimizu
2012/0247494 A1 10/2012 Oglesby et al.
2013/0037041 A1 2/2013 Worm et al.
2013/0213419 A1 8/2013 Tucker et al.
2013/0284192 A1 10/2013 Peleg et al.
2013/0319439 A1 12/2013 Gorelick et al.
2013/0340775 A1 12/2013 Juster et al.
2014/0020698 A1 1/2014 Fiebelkorn
2014/0096782 A1 4/2014 Ampolini et al.
2014/0116455 A1 5/2014 Youn
2014/0246035 A1 9/2014 Minskoff et al.
2014/0299137 A1 10/2014 Kieckbusch et al.
2014/0301721 A1 10/2014 Ruscio et al.
2014/0305448 A1 10/2014 Zuber et al.
2014/0318559 A1 10/2014 Thorens et al.
2014/0345633 A1 11/2014 Talon et al.
2014/0345634 A1 11/2014 Zuber et al.
2014/0363145 A1 12/2014 Plojoux et al.
2015/0007838 A1 1/2015 Fernando et al.
2015/0013696 A1 1/2015 Plojoux et al.
2015/0020832 A1 1/2015 Greim et al.
2015/0024355 A1 1/2015 Ghofrani et al.
2015/0027474 A1 1/2015 Zuber et al.
2015/0100441 A1 4/2015 Alarcon et al.
2015/0136124 A1 5/2015 Aronie et al.
2015/0136154 A1 5/2015 Mitrev et al.
2015/0201676 A1 7/2015 Shin
2015/0208725 A1 7/2015 Tsai
2015/0245654 A1 9/2015 Memari et al.
2015/0257445 A1 9/2015 Henry, Jr. et al.
2015/0272211 A1 10/2015 Chung
2016/0150824 A1 6/2016 Memari et al.
2016/0205998 A1 7/2016 Matsumoto et al.
2016/0270437 A1 9/2016 Nappi
2016/0286861 A1 10/2016 Liu
2016/0302488 A1 10/2016 Fernando et al.
2016/0031032 A1 11/2016 Malgat et al.
2016/0331032 A1 11/2016 Malgat et al.
2016/0345629 A1 12/2016 Mironov
2016/0366946 A1 12/2016 Murison et al.
2016/0374402 A1 12/2016 Fernando et al.
2017/0006916 A1 1/2017 Liu
2017/0027229 A1 2/2017 Cameron
2017/0027234 A1 2/2017 Farine et al.
2017/0042243 A1 2/2017 Plojoux et al.
2017/0042251 A1 2/2017 Yamada et al.
2017/0055580 A1 3/2017 Blandino et al.
2017/0065002 A1 3/2017 Fernando et al.
2017/0071251 A1 3/2017 Goch
2017/0095006 A1 4/2017 Egoyants et al.
2017/0150757 A1 6/2017 Worm et al.
2017/0164659 A1 6/2017 Schneider et al.
2017/0172214 A1 6/2017 Li et al.
2017/0172215 A1 6/2017 Li et al.
2017/0188634 A1 7/2017 Plojoux et al.
2017/0238596 A1 8/2017 Matsumoto et al.
2018/0110263 A1* 4/2018 Borkovec ..... A24F 40/20
2018/0177234 A1 6/2018 Lee
2018/0206556 A1 7/2018 Thorens et al.
2018/0235283 A1 8/2018 Zuber et al.
2019/0014826 A1 1/2019 Thorens et al.
2019/0075849 A1 3/2019 Hawes
2019/0320719 A1 10/2019 Liu et al.
2019/0364975 A1 12/2019 Fernando et al.
2020/0006950 A1 1/2020 Holzherr
2020/0120983 A1 4/2020 Chen
2020/0154765 A1* 5/2020 Lee ..... A24F 40/20
2020/0170298 A1* 6/2020 Lee ..... A24F 40/40
2020/0232766 A1 7/2020 Flick
2020/0305508 A1 10/2020 Talon
2020/0352224 A1 11/2020 Plojoux et al.
2020/0413495 A1 12/2020 Schneider et al.
2021/0000182 A1 1/2021 Ruscio et al.
2021/0120875 A1 4/2021 Mironov

FOREIGN PATENT DOCUMENTS

CN 1102964 A 5/1995
CN 1209731 A 3/1999
CN 1973706 A 6/2007

(56) References Cited

FOREIGN PATENT DOCUMENTS

| | | | |
|---|---|---|---|
| CN | 101043827 | A | 9/2007 |
| CN | 101444335 | A | 6/2009 |
| CN | 102006790 | A | 4/2011 |
| CN | 102438470 | A | 5/2012 |
| CN | 202407082 | U | 9/2012 |
| CN | 202774134 | U | 3/2013 |
| CN | 103096741 | A | 5/2013 |
| CN | 103281920 | A | 9/2013 |
| CN | 103338665 | A | 10/2013 |
| CN | 203457802 | U | 3/2014 |
| CN | 103859606 | A | 6/2014 |
| CN | 203633505 | U | 6/2014 |
| CN | 103929988 | A | 7/2014 |
| CN | 203689071 | U | 7/2014 |
| CN | 103974640 | A | 8/2014 |
| CN | 103997921 | A | 8/2014 |
| CN | 103997922 | A | 8/2014 |
| CN | 203789137 | U | 8/2014 |
| CN | 104023568 | A | 9/2014 |
| CN | 104023574 | A | 9/2014 |
| CN | 104039183 | A | 9/2014 |
| CN | 104095295 | A | 10/2014 |
| CN | 104106842 | A | 10/2014 |
| CN | 203943078 | U | 11/2014 |
| CN | 204070570 | U | 1/2015 |
| CN | 204146338 | U | 2/2015 |
| CN | 104382237 | A | 3/2015 |
| CN | 104470387 | A | 3/2015 |
| CN | 104489933 | A | 4/2015 |
| CN | 104544559 | A | 4/2015 |
| CN | 204317494 | U | 5/2015 |
| CN | 204317504 | U | 5/2015 |
| CN | 104754964 | A | 7/2015 |
| CN | 104770878 | A | 7/2015 |
| CN | 104812260 | A | 7/2015 |
| CN | 204444239 | U | 7/2015 |
| CN | 204763414 | U | 11/2015 |
| CN | 105163610 | A | 12/2015 |
| CN | 105208882 | A | 12/2015 |
| CN | 105208884 | A | 12/2015 |
| CN | 105341993 | A | 2/2016 |
| CN | 105357994 | A | 2/2016 |
| CN | 205018293 | U | 2/2016 |
| CN | 105361250 | A | 3/2016 |
| CN | 105453598 | A | 3/2016 |
| CN | 205180371 | U | 4/2016 |
| CN | 205197003 | U | 5/2016 |
| CN | 205337598 | U | 6/2016 |
| CN | 105747281 | A | 7/2016 |
| CN | 105831812 | A | 8/2016 |
| CN | 105876869 | A | 8/2016 |
| CN | 205512358 | U | 8/2016 |
| CN | 205597118 | U | 9/2016 |
| CN | 106037014 | A | 10/2016 |
| CN | 205648910 | U | 10/2016 |
| CN | 106102492 | A | 11/2016 |
| CN | 106132217 | A | 11/2016 |
| CN | 106163307 | A | 11/2016 |
| CN | 205728067 | U | 11/2016 |
| CN | 106174699 | A | 12/2016 |
| CN | 106231934 | A | 12/2016 |
| CN | 106413439 | A | 2/2017 |
| CN | 106413444 | A | 2/2017 |
| CN | 106455708 | A | 2/2017 |
| CN | 106455714 | A | 2/2017 |
| CN | 106455716 | A | 2/2017 |
| CN | 106473233 | A | 3/2017 |
| CN | 106901404 | A | 6/2017 |
| CN | 105342011 | B | 6/2018 |
| DE | 3302518 | A1 | 7/1984 |
| EA | 012169 | B1 | 8/2009 |
| EA | 026076 | B1 | 2/2017 |
| EP | 1119267 | B1 | 7/2004 |
| EP | 2 201 850 | A1 | 6/2010 |
| EP | 2253233 | A1 | 11/2010 |
| EP | 2316286 | A1 | 5/2011 |
| EP | 2 531 053 | B1 | 9/2015 |
| EP | 2 432 339 | B1 | 3/2017 |
| EP | 3 275 319 | B1 | 8/2020 |
| ER | 2113178 | A1 | 11/2009 |
| ER | 3 098 738 | A1 | 11/2016 |
| ER | 3 179 828 | A1 | 6/2017 |
| GB | 2542018 | A | 3/2017 |
| JP | 3-232481 | A | 10/1991 |
| JP | 7-184627 | A | 7/1995 |
| JP | 11-164679 | A | 6/1999 |
| JP | 3645921 | B2 | 5/2005 |
| JP | 2006-320286 | A | 11/2006 |
| JP | 4278306 | B2 | 6/2009 |
| JP | 2010-178730 | A | 8/2010 |
| JP | 2010-526553 | A | 8/2010 |
| JP | 2011-87569 | A | 5/2011 |
| JP | 2011-518567 | A | 6/2011 |
| JP | 4739433 | B2 | 8/2011 |
| JP | 2012-527222 | A | 11/2012 |
| JP | 2014-500017 | A | 1/2014 |
| JP | 2014-521419 | A | 8/2014 |
| JP | 2014-525237 | A | 9/2014 |
| JP | 2014-533513 | A | 12/2014 |
| JP | 2014-534813 | A | 12/2014 |
| JP | 2015-503916 | A | 2/2015 |
| JP | 2015-506170 | A | 3/2015 |
| JP | 2015-507477 | A | 3/2015 |
| JP | 2015-508996 | A | 3/2015 |
| JP | 2015-524261 | A | 8/2015 |
| JP | 2015-180214 | A | 10/2015 |
| JP | 2015-529458 | A | 10/2015 |
| JP | 2015-204833 | A | 11/2015 |
| JP | 2016-528910 | A | 9/2016 |
| JP | 3207506 | U | 11/2016 |
| JP | 2017-51189 | A | 3/2017 |
| JP | 2017-70297 | A | 4/2017 |
| JP | 2017-514463 | A | 6/2017 |
| KR | 10-0304044 | B1 | 11/2001 |
| KR | 10-0636287 | B1 | 10/2006 |
| KR | 10-0806461 | B1 | 2/2008 |
| KR | 10-0965099 | B1 | 6/2010 |
| KR | 10-1001077 | B1 | 12/2010 |
| KR | 10-2011-0096548 | A | 8/2011 |
| KR | 20-2011-0009632 | U | 10/2011 |
| KR | 10-1098112 | B1 | 12/2011 |
| KR | 10-2012-0027029 | A | 3/2012 |
| KR | 10-2012-0101637 | A | 9/2012 |
| KR | 10-1184499 | B1 | 9/2012 |
| KR | 10-2012-0109634 | A | 10/2012 |
| KR | 10-2012-0114333 | A | 10/2012 |
| KR | 10-2012-0121314 | A | 11/2012 |
| KR | 10-2013-0027909 | A | 3/2013 |
| KR | 20-0466757 | Y1 | 5/2013 |
| KR | 10-2013-0081238 | A | 7/2013 |
| KR | 10-2013-0139296 | A | 12/2013 |
| KR | 10-2014-0015774 | A | 2/2014 |
| KR | 10-1383577 | B1 | 4/2014 |
| KR | 10-2014-0068203 | A | 6/2014 |
| KR | 10-2014-0092312 | A | 7/2014 |
| KR | 10-2014-0116055 | A | 10/2014 |
| KR | 10-2014-0118983 | A | 10/2014 |
| KR | 10-2014-0119072 | A | 10/2014 |
| KR | 10-2014-0135774 | A | 11/2014 |
| KR | 10-2015-0030409 | A | 3/2015 |
| KR | 10-2015-0033617 | A | 4/2015 |
| KR | 10-2015-0058569 | A | 5/2015 |
| KR | 10-1516304 | B1 | 5/2015 |
| KR | 10-1523088 | B1 | 5/2015 |
| KR | 10-2015-0099704 | A | 9/2015 |
| KR | 10-2015-0099771 | A | 9/2015 |
| KR | 10-2016-0009678 | A | 1/2016 |
| KR | 10-2016-0012110 | A | 2/2016 |
| KR | 10-2016-0012329 | A | 2/2016 |
| KR | 10-2016-0015144 | A | 2/2016 |
| KR | 10-2016-0040643 | A | 4/2016 |
| KR | 10-1609715 | B1 | 4/2016 |
| KR | 10-2016-0052607 | A | 5/2016 |
| KR | 10-2016-0060006 | A | 5/2016 |

(56) References Cited

FOREIGN PATENT DOCUMENTS

| | | | |
|---|---|---|---|
| KR | 10-1619032 | B1 | 5/2016 |
| KR | 20-2016-0001476 | U | 5/2016 |
| KR | 10-2016-0088163 | A | 7/2016 |
| KR | 10-2016-0094938 | A | 8/2016 |
| KR | 10-2016-0096744 | A | 8/2016 |
| KR | 10-2016-0108855 | A | 9/2016 |
| KR | 10-1656061 | B1 | 9/2016 |
| KR | 10-2016-0114743 | A | 10/2016 |
| KR | 10-2016-0124091 | A | 10/2016 |
| KR | 10-1667124 | B1 | 10/2016 |
| KR | 10-1668175 | B1 | 10/2016 |
| KR | 10-2016-0129024 | A | 11/2016 |
| KR | 10-2016-0131035 | A | 11/2016 |
| KR | 10-2016-0133665 | A | 11/2016 |
| KR | 10-2016-0137627 | A | 11/2016 |
| KR | 10-1679489 | B1 | 11/2016 |
| KR | 10-2016-0140608 | A | 12/2016 |
| KR | 10-2016-0142896 | A | 12/2016 |
| KR | 10-2016-0147253 | A | 12/2016 |
| KR | 10-1690389 | B1 | 12/2016 |
| KR | 10-2017-0006282 | A | 1/2017 |
| KR | 10-2017-0007262 | A | 1/2017 |
| KR | 10-2017-0044158 | A | 4/2017 |
| KR | 10-2017-0071486 | A | 6/2017 |
| KR | 10-2017-0074898 | A | 6/2017 |
| KR | 10-1740160 | B1 | 6/2017 |
| RU | 2302806 | C2 | 7/2007 |
| RU | 2425608 | C2 | 8/2011 |
| RU | 2 531 890 | C2 | 10/2014 |
| RU | 2564600 | C1 | 10/2015 |
| RU | 2014 125 232 | A | 12/2015 |
| RU | 2581999 | C2 | 4/2016 |
| RU | 2589437 | C2 | 7/2016 |
| RU | 2594557 | C2 | 8/2016 |
| RU | 2595593 | C2 | 8/2016 |
| RU | 2 602 053 | C2 | 11/2016 |
| RU | 2 602 962 | C2 | 11/2016 |
| RU | 2 603 559 | C2 | 11/2016 |
| RU | 2 604 012 | C2 | 12/2016 |
| RU | 2604012 | C2 | 12/2016 |
| WO | 94/06314 | A1 | 3/1994 |
| WO | 98/23171 | A1 | 6/1998 |
| WO | 00/27232 | A1 | 5/2000 |
| WO | 2010/133342 | A1 | 11/2010 |
| WO | 2011/028372 | A1 | 3/2011 |
| WO | 2011/050964 | A1 | 5/2011 |
| WO | 2011/095781 | A1 | 8/2011 |
| WO | 2012/072264 | A1 | 6/2012 |
| WO | 2012/123702 | A1 | 9/2012 |
| WO | 2013/034458 | A1 | 3/2013 |
| WO | 2013/060743 | A2 | 5/2013 |
| WO | 2013/076098 | A2 | 5/2013 |
| WO | 2013/098395 | A1 | 7/2013 |
| WO | 2013/098398 | A3 | 7/2013 |
| WO | 2013/098409 | A1 | 7/2013 |
| WO | 2013/102609 | A2 | 7/2013 |
| WO | 2013/102612 | A2 | 7/2013 |
| WO | 2013102609 | A2 | 7/2013 |
| WO | 2013/120565 | A3 | 8/2013 |
| WO | 2013/126777 | A2 | 8/2013 |
| WO | 2013/137084 | A1 | 9/2013 |
| WO | 2013/171217 | A1 | 11/2013 |
| WO | 2013/190036 | A1 | 12/2013 |
| WO | 2014/029880 | A2 | 2/2014 |
| WO | 2015/046386 | A1 | 4/2015 |
| WO | 2015/088744 | A1 | 6/2015 |
| WO | 2015/128665 | A1 | 9/2015 |
| WO | 2015/155289 | A1 | 10/2015 |
| WO | 2015/165813 | A1 | 11/2015 |
| WO | 2015/177044 | A1 | 11/2015 |
| WO | 2015/197627 | A1 | 12/2015 |
| WO | 2016/059073 | A1 | 4/2016 |
| WO | 2016/075028 | A1 | 5/2016 |
| WO | 2016/076147 | A1 | 5/2016 |
| WO | 2016/107766 | A1 | 7/2016 |
| WO | 2016/124550 | A1 | 8/2016 |
| WO | 2016/124552 | A1 | 8/2016 |
| WO | 2016/150019 | A1 | 9/2016 |
| WO | 2016/156103 | A1 | 10/2016 |
| WO | 2016/156219 | A1 | 10/2016 |
| WO | 2016/159013 | A1 | 10/2016 |
| WO | 2016/166064 | A1 | 10/2016 |
| WO | 2016/178377 | A1 | 11/2016 |
| WO | 2017/029088 | A1 | 2/2017 |
| WO | 2017/029089 | A1 | 2/2017 |
| WO | 2017/037457 | A1 | 3/2017 |
| WO | 2017/042297 | A1 | 3/2017 |
| WO | 2017/075759 | A1 | 5/2017 |
| WO | 2017/139963 | A1 | 8/2017 |
| WO | 2018/050449 | A1 | 3/2018 |
| WO | 2018/189195 | A1 | 10/2018 |
| WO | 2019/020826 | A1 | 1/2019 |
| WO | 2019/030172 | A1 | 2/2019 |
| WO | 2019/095268 | A1 | 5/2019 |

OTHER PUBLICATIONS

Office Action dated Dec. 11, 2019 in Korean Application No. 10-2018-0010841.

Office Action dated Dec. 19, 2019 in Korean Application No. 10-2018-0090910.

Office Action dated Jan. 3, 2020 in Korean Application No. 10-2018-0012456.

Office Action dated Jan. 3, 2020 in Korean Application No. 10-2017-0084389.

Office Action dated Jan. 3, 2020 in Korean Application No. 10-2017-0084386.

Office Action dated Jan. 3, 2020 in Korean Application No. 10-2018-0018693.

Office Action dated Jan. 8, 2020 in Korean Application No. 10-2017-0128293.

Office Action dated Jan. 8, 2020 in Korean Application No. 10-2017-0119664.

Office Action dated Jan. 16, 2020 in Korean Application No. 10-2017-0084388.

Office Action dated Jan. 16, 2020 in Korean Application No. 10-2017-0084387.

Office Action dated Feb. 11, 2020 in Korean Application No. 10-2018-0010834.

Office Action dated Feb. 11, 2020 in Korean Application No. 10-2018-0010835.

Office Action dated Feb. 13, 2020 in Korean Application No. 10-2018-0010837.

Office Action dated Feb. 18, 2020 in Russian Application No. 2019121813.

International Search Report dated Jul. 24, 2018 in International Application No. PCT/KR2018/003691.

Office Action dated Jul. 2, 2019 in Korean Application No. 10-2019-0018815.

Office Action dated Jul. 3, 2019 in Korean Application No. 10-2019-0017391.

International Search Report dated Oct. 29, 2018 in International Application No. PCT/KR2018/004181.

International Search Report dated Sep. 6, 2018 in International Application No. PCT/KR2018/004179.

International Search Report dated Nov. 6, 2018 in International Application No. PCT/KR2018/004178.

International Search Report dated Sep. 6, 2018 in International Application No. PCT/KR2018/004176.

International Search Report dated Sep. 7, 2018 in International Application No. PCT/KR2018/004172.

International Search Report dated Sep. 7, 2018 in International Application No. PCT/KR2018/004171.

International Search Report dated Nov. 6, 2018 in International Application No. PCT/KR2018/004130.

International Search Report dated Nov. 14, 2018 in International Application No. PCT/KR2018/004118.

International Search Report dated May 29, 2018 in International Application No. PCT/KR2017/012486.

(56) References Cited

OTHER PUBLICATIONS

Office Action dated Aug. 7, 2019 for Korean Patent Application No. 10-2018-0067035, and its English translation provided by Applicants foreign counsel.
Office Action dated Jun. 27, 2019 for Korean Patent Application No. 10-2018-0063759, and its English translation provided by Applicants foreign counsel.
Office Action dated Jul. 2, 2019 for Korean Patent Application No. 10-2019-0018815, and its English translation provided by Applicants foreign counsel.
Office Action dated Jul. 3, 2019 for Korean Patent Application No. 10-2019-0017391, and its English translation provided by Applicants foreign counsel.
International Preliminary Report on Patentability (Chapter I) dated Jun. 18, 2019 for PCT/KR2017/012486 and its English translation from WIPO.
Written Opinion of the International Searching Authority for PCT/KR2017/012486 dated May 29, 2018 and its English translation by Google Translate (now published as WO 2018/110834).
Partial supplementary European search report dated Aug. 3, 2020 in Application No. 17880867.1.
Extended European search report dated Nov. 4, 2020 by the European Patent Office in Application No. 17880867.1.
Office Action dated Oct. 29, 2020 by the Korean Patent Office in Application No. 10-2018-0010837.
Office Action dated Nov. 4, 2020 by the Japanese Patent Office in Application No. 2019-554453.
Office Action dated Nov. 4, 2020 by the Japanese Patent Office in Application No. 2020-128346.
Decision on Grant dated Nov. 26, 2020 by the Russian Federal Service for Intellectual Property Patent Application No. 2020124607.
Office Action dated Nov. 26, 2020 by Russian Federal Service for Intellectual Property Office Patent Application No. 2020124609.
Decision on Grant dated Oct. 26, 2020 by Russian Federal Service for Intellectual Property in Application No. 2020124610.
Office Action dated Jun. 29, 2020 by the Korean Patent Office in Application No. 10-2018-0010836.
Office Action dated Nov. 14, 2019 in Korean Application No. 10-2017-0084385.
Office Action dated Nov. 14, 2019 in Korean Application No. 10-2017-0147605.
Extended European Search Report dated Dec. 11, 2020 in European Application No. 20188967.2.
Extended European Search Report dated Dec. 16, 2020 in European Application No. 20188985.4.
Office Action dated Dec. 30, 2020 in Russian Application No. 2020124651.
Office Action dated Dec. 28, 2020 in Russian Application No. 2020124652.
Office Action dated Dec. 11, 2020 in Russian Application No. 2020124653.
Office Action dated Jan. 22, 2021 in Russian Application No. 2020124657.
Office Action dated Jan. 22, 2021 in Russian Application No. 2020124658.
Extended European Search Report dated Dec. 18, 2020 in European Application No. 18775504.6.
Office Action dated Jan. 19, 2021 in Japanese Application No. 2019-553569.
Extended European Search Report dated Jan. 14, 2021 in European Application No. 18784738.9.
Extended European Search Report dated Dec. 10, 2020 in European Application No. 20188932.6.
Office Action dated Jan. 12, 2021 in Japanese Application No. 2019-555201.
Office Action dated Jan. 12, 2021 in Japanese Application No. 2019-555169.
Office Action dated Jan. 5, 2021 in Japanese Application No. 2019-558557.
Extended European Search Report dated Nov. 19, 2020 in European Application No. 20188792.4.
Office Action dated Dec. 1, 2020 in Japanese Application No. 2020-501188.
Extended European Search Report dated Dec. 18, 2020 in European Application No. 20188926.8.
Office Action dated Jan. 19, 2021 in Japanese Application No. 2020-501514.
Office Action dated Sep. 24, 2020 in Korean Application No. 10-2018-0012456.
Office Action dated May 28, 2020 in Korean Application No. 10-2017-0147605.
Office Action dated Jul. 22, 2021 in Korean Application No. 10-2021-0051359.
Extended European Search Report dated Apr. 1, 2021 in European Application No. 18805933.1.
Extended European Search Report dated Jan. 15, 2021 in European Application No. 20188949.0.
Extended European Search Report dated Jul. 1, 2021 in European Application No. 18854661.8.
Extended European Search Report dated Jun. 14, 2021 in European Application No. 18842951.8.
Extended European Search Report dated Jun. 16, 2021 in European Application No. 18853434.1.
International Search Report dated Aug. 29, 2018 in International Application No. PCT/KR2018/005945.
International Search Report dated Dec. 4, 2018 in International Application No. PCT/KR2018/006747.
International Search Report dated Feb. 28, 2019 in International Application No. PCT/KR2018/009100.
International Search Report dated Nov. 26, 2018 in International Application No. PCT/KR2018/009094.
International Search Report dated Nov. 30, 2018 in International Application No. PCT/KR2018/006702.
International Search Report dated Nov. 6, 2018 in International Application No. PCT/KR2018/004129.
Office Action dated Apr. 25, 2019 in Korean Application No. 10-2019-0033784.
Office Action dated Apr. 4, 2019 in Korean Application No. 10-2019-0019194.
Office Action dated Apr. 4, 2019 in Korean Application No. 10-2019-0019195.
Office Action dated Apr. 5, 2019 in Korean Application No. 10-2019-0027638.
Office Action dated Apr. 9, 2021 in Korean Application No. 10-2020-0116256.
Office Action dated Jun. 10, 2021 in Russian Application No. 2020124657.
Office Action dated Jun. 10, 2021 in Russian Application No. 2020124658.
Office Action dated Jun. 29, 2021 in Chinese Application No. 201880022072.2.
Office Action dated May 5, 2021 in Canadian Application No. 3,047,236.
Extended European Search Report dated Jan. 14, 2021 in European Application No. 18783776.0.
Extended European Search Report dated Jan. 25, 2021 in European Application No. 18785166.2.
Extended European Search Report dated Jan. 29, 2021 in European Application No. 18784464.2.
Extended European Search Report dated Mar. 15, 2021 in European Application No. 18785061.5.
Extended European Search Report dated Mar. 19, 2021 in European Application No. 18784164.8.
Extended European Search Report dated Mar. 24, 2021 in European Application No. 18784268.7.
Extended European Search Report dated Mar. 25, 2021 in European Application No. 18784370.1.
Extended European Search Report dated Mar. 25, 2021 in European Application No. 18784841.1.
Office Action dated Feb. 24, 2021 in Japanese Application No. 2019-555168.

(56) References Cited

OTHER PUBLICATIONS

Office Action dated Feb. 24, 2021 in Japanese Application No. 2019-555203.
Office Action dated Feb. 24, 2021 in Japanese Application No. 2019-555204.
Office Action dated Feb. 4, 2021 in Russian Application No. 2020124609.
Office Action dated Feb. 9, 2021 in Japanese Application No. 2019-555184.
Office Action dated Jan. 26, 2021 in Japanese Application No. 2020-501521.
Office Action dated Mar. 2, 2021 in Japanese Application No. 2019-555170.
Office Action dated Mar. 2, 2021 in Japanese Application No. 2019-555182.
Office Action dated Mar. 30, 2021 in Japanese Application No. 2020-501377.
Office Action dated Jan. 19, 2021 in Indonesian Application No. P00201906007.
Communication dated Aug. 16, 2021 by the Chinese Patent Office in Chinese Application No. 201880024006.9.
Communication dated Aug. 26, 2021 by the Chinese Patent Office in Chinese Application No. 201880024107.6.
Communication dated Aug. 4, 2021 by the Chinese Patent Office in Chinese Application No. 201880024289.7.
Communication dated Jul. 16, 2021 by the Chinese Patent Office in Chinese Application No. 201880024367.3.
Communication dated Jul. 19, 2021 by the Chinese Patent Office in Chinese Application No. 201880024070.7.
Communication dated Jul. 26, 2021 by the Chinese Patent Office in Chinese Application No. 201880024059.0.
Communication dated Jul. 27, 2021 by the Chinese Patent Office in Chinese Application No. 201780084891.5.
Communication dated Sep. 17, 2021 by the Chinese Patent Office in Chinese Application No. 201880030699.2.
Office Action dated Sep. 29, 2021 in Chinese Application No. 201880024311.8.
Office Action dated Sep. 24, 2021 in Chinese Application No. 201880024010.5.
Office Action dated Sep. 29, 2021 in Chinese Application No. 201880024276.X.
Office Action dated Oct. 28, 2021 in Chinese Application No. 201880046418.2.
Extended European Search Report dated Oct. 27, 2021 in European Application No. 18844735.3.
Office Action dated Nov. 25, 2021, issued by the China National Intellectual Property Office in Application No. 201880047174.X.
Office Action dated Dec. 1, 2021, issued by the State Intellectual Property Office in P.R.C. in application No. 201880046367.3.

* cited by examiner

AEROSOL GENERATING DEVICE

CROSS REFERENCE TO RELATED APPLICATIONS

This application is a National Stage of International Application No. PCT/KR2018/004178, filed Apr. 10, 2018, claiming priorities to Korean Patent Application No. 10-2017-0046938 filed Apr. 11, 2017, Korean Patent Application No. 10-2017-0077586 filed Jun. 19, 2017 and Korean Patent Application No. 10-2017-0084390 filed Jul. 3, 2017.

TECHNICAL FIELD

One or more embodiments relate to an aerosol generating device, and more particularly, to an aerosol generating device in which a container and a cigarette move in a direction opposite to a direction in which the cigarette is extracted before the cigarette is separated from the heater, so that the cigarette is conveniently separated from the heater and residue is discharged together with the cigarette to the outside of the aerosol generating device.

BACKGROUND ART

Recently, demand has increased for a method of generating an aerosol by heating an aerosol generating material in a cigarette. Thus, research into a heated cigarette or a heated aerosol generating device has been actively conducted.

An aerosol generating device may include a liquid nicotine vaporizer for vaporizing tobacco in a liquid state or an aerosol generating device for generating smoking gas by heating and fumigating a cigarette.

When an aerosol generating device including a heater for heating a cigarette by using electricity is used, the cigarette, which is heated by the heater and generates smoking gas, may be separated from the aerosol generating device and discarded, and a new cigarette may be inserted into the aerosol generating device.

Korean Patent Registration No. 10-1667124 relates to an aerosol generating device for generating smoking gas by heating a cigarette and describes a structure of a holder for supporting insertion of a cigarette into the aerosol generating device or removal of a cigarette from the aerosol generating device.

When a user uses an aerosol generating device having this structure, the user, for smoking, inserts the cigarette into the holder extracted to the outside of the aerosol generating device and pushes the holder and the cigarette into the aerosol generating device, and after smoking, pulls the holder to the outside of the aerosol generating device and then removes the cigarette from the holder.

In the aerosol generating device using the holder having this structure, the holder only guides the insertion and the separation of the cigarette. Thus, because residue generated from the cigarette heated during smoking remains in the inner space and in components of the aerosol generating device, such as the heater, etc., it is difficult to keep the aerosol generating device clean.

When the user removes the cigarette from the aerosol generating device, the user holds, in his or her hand, the cigarette inserted into the holder and pulls the cigarette out of the holder to remove the cigarette. However, tobacco materials remaining on contacting surfaces of the cigarette and the heater are not removed during the removal of the cigarette, and remain in the heater. The tobacco materials generated from the cigarette are attached to the contacting surfaces between the cigarette and the heater, and the tobacco materials attached to the heater are compressed by heat of the heater and thus more strongly adhere to the heater. Thus, as the time during which the aerosol generating device is used increases, the cleanliness of the heater and the inner space of the aerosol generating device may decrease.

DESCRIPTION OF EMBODIMENTS

Technical Problem

Provided are a method and device for generating an aerosol. Also, provided is a computer-readable recording medium having recorded thereon a program for executing the method above on a computer. Embodiments are not limited to the technical objectives described above and may include other technical objectives.

Provided is an aerosol generating device for allowing convenient removal of a cigarette.

Provided is an aerosol generating device capable of removing a material attached to a heater.

Solution to Problem

According to an aspect of the disclosure, there is provided an aerosol generating device including: a case; a container mounted inside the case to be movable in a longitudinal direction of the case and having an accommodating space configured to accommodate a cigarette; a heater disposed inside the case such that a front end thereof is inserted into the accommodating space of the container, the heater being configured to heat the cigarette when electricity is applied thereto; and an elastic support portion configured to elastically support the container with respect to the case.

The case may include a guide space configured to guide the container to move linearly.

The container may further have a through-hole through which the front end of the heater passes.

A size of the through-hole may correspond to a thickness of the front end of the heater, and while the container moves, the through-hole may contact the heater and thus scrapes a material attached to a surface of the heater.

The aerosol generating device may further include, on a surface of the front end of the heater, a coating layer including a wear-resistant material.

A size of the through-hole may be greater than a size of the front end of the heater such that an inner surface of the through-hole may be spaced apart from the front end of the heater.

The aerosol generating device may further include a fixing portion coupled to a rear end of the heater and configured to fix a position of the heater with respect to the case, wherein the elastic support portion is disposed between the fixing portion and the container.

The container may further have an expansion portion in which an inner diameter of an end of the container extends outwards, and the case may have an insertion portion inserted between an inner wall surface of the expansion portion of the container and an outer circumferential surface of the cigarette and extending linearly in a direction in which the container moves.

The container may further have a stepped portion formed on an outer surface of the expansion portion, the outer surface facing toward the fixing portion, and the elastic support portion may be disposed between the stepped portion and the fixing portion.

The aerosol generating device may further include a stopper disposed between the container and the case and configured to apply resistance in a direction opposite to a direction in which the container moves.

According to another aspect of the disclosure, there is provided an aerosol generating system including: a holder configured to heat a cigarette to generate an aerosol; and a cradle having an inner space into which the holder is inserted, wherein the holder is inserted into the inner space of the cradle and then is tilted to generate the aerosol.

According to another aspect of the disclosure, there is provided a cigarette inserted into a holder, the cigarette including: a tobacco load including a plurality of tobacco strands; a first filter segment including a hollow; a cooling structure configured to cool a generated aerosol; and a second filter segment.

Advantageous Effects of Disclosure

According to the one or more of the embodiments, in an aerosol generating device, before a cigarette is separated, the cigarette and a container may move in a direction opposite to a direction in which the cigarette is extracted from a heater, and thus, contact surfaces of the cigarette and the heater may be easily separated from each other.

Also, while the container and the cigarette move, the heater may remain in a fixed state. Also, due to movement of the container and the cigarette to a press position and back to an initial position, residues attached to a surface of the heater may be separated from the heater, and thus, the residues may be easily discharged to the outside of the aerosol generating device.

BEST MODE

The terms used in the embodiments are selected from among common terms that are currently widely used in consideration of their function in the disclosure. However, the terms may be different according to an intention of one of ordinary skill in the art, a precedent, or the advent of new technology. In addition, in certain cases, a term which is not commonly used may be selected. In such a case, the meaning of the term will be described in detail at the corresponding part in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er," "-or," and "module" described in the specification mean units for processing at least one function and operation and can be implemented by hardware components or software components and combinations thereof.

Hereinafter, embodiments will be described in detail by referring to the accompanying drawings. However, the disclosure may be realized in many different forms and is not limited to the embodiments described herein.

Figure 1:
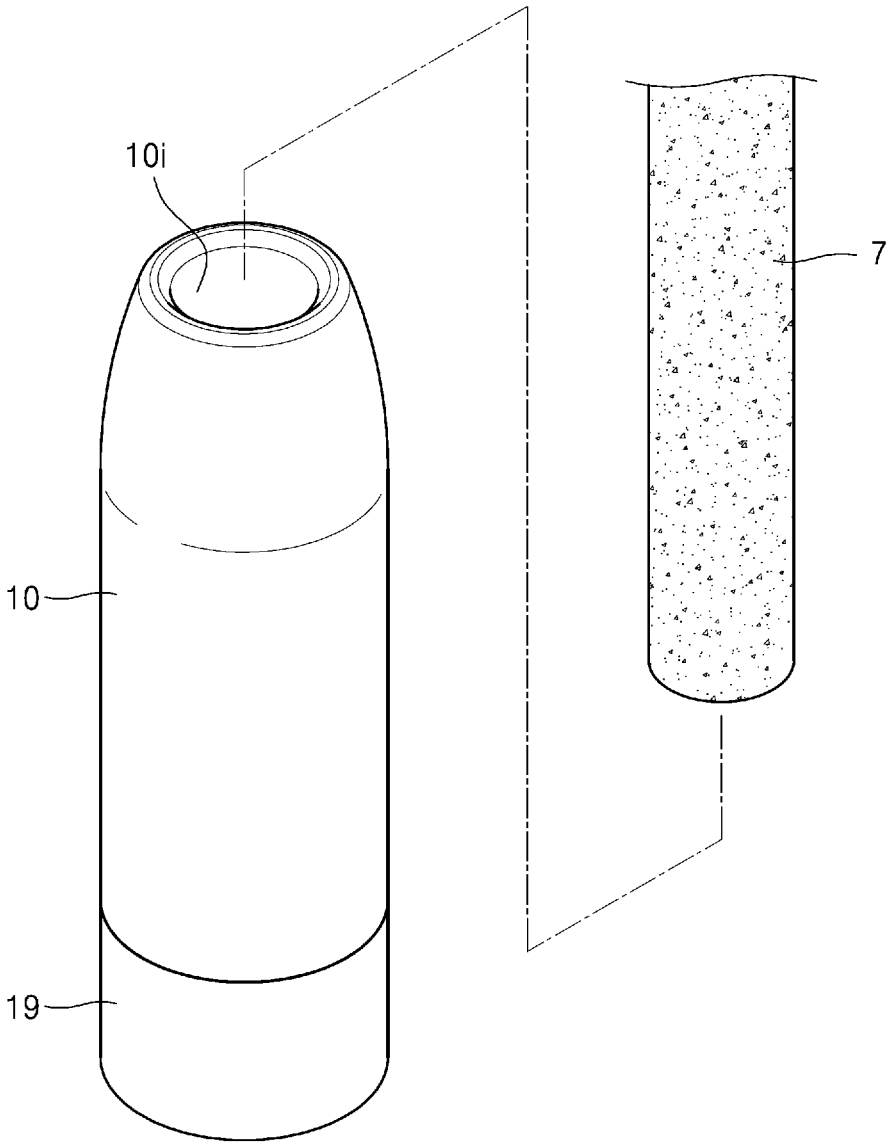
FIG. 1 is a perspective view of an example of an operational state of an aerosol generating device according to an embodiment.
Figure 2:
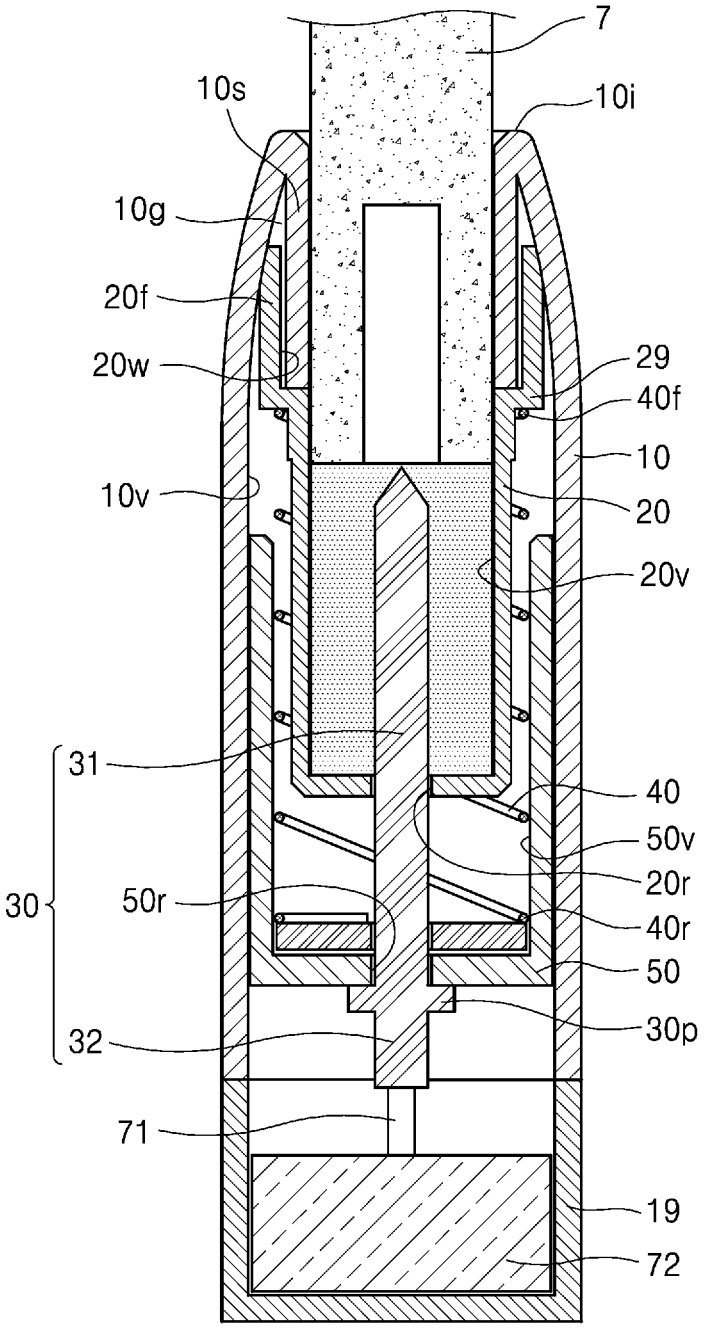
FIG. 2 is a cross-sectional view of a state in which a cigarette is mounted in the aerosol generating device according to the embodiment illustrated in FIG. 1.

FIG. 1 is a perspective view of an example of an operational state of an aerosol generating device according to an embodiment and FIG. 2 is a cross-sectional view of a state in which a cigarette is mounted in the aerosol generating device according to the embodiment illustrated in FIG. 1.

The aerosol generating device according to the embodiment illustrated in FIGS. 1 and 2 may include a case 10, a container 20 mounted in the case 10 to be movable in a longitudinal direction of the case 10, wherein the container 20 includes an accommodating space 20*v* configured to accommodate a cigarette 7, a heater 30 disposed in the case 10 such that a front end 31 thereof is inserted into the accommodating space 20*v* of the container 20, wherein the heater 30 is configured to heat the cigarette 7, and an elastic support portion 40 configured to elastically support the container 20 with respect to the case 10.

The case 10 may form an exterior shape of the aerosol generating device and may accommodate and protect various components in an inner space 10*v* formed inside the case 10. The case 10 may have a hollow cylindrical shape and may have, at a front end thereof, an opening 10*i* which is open to the outside and through which the cigarette 7 may be inserted. The case 10 may be formed by including a plastic material not transferring electricity and heat or a metal material having a surface coated with a plastic material.

The container 20 may be mounted in the case 10 to be movable in the longitudinal direction of the case 10. The cigarette 7 may be formed to have a cylindrical shape and the container 20 and the case 10 may extend in a longitudinal direction of the cigarette 7 to correspond to the shape of the cigarette 7.

The container 20 may be formed to have a cylindrical shape which is empty inside and may have, at a front end and a rear end thereof, respectively, an opening through which the cigarette 7 is inserted and a through-hole 20*r* through which the front end 31 of the heater 30 passes. Also, the container 20 may have the accommodating space 20*v* configured to accommodate the cigarette 7.

While the container 20 is accommodated in the case 10, the container 20 may accommodate and support the cigarette 7 and may move in the longitudinal direction of the case 10 together with the cigarette 7. Thus, the container 20 may not be detached outwards from the case 10.

The heater 30 configured to heat the cigarette 7 may be disposed in the case 10. The front end 31 of the heater 30 may be inserted into the container 20 through the through-hole 20*r* of the container 20 and when the cigarette 7 is accommodated in the container 20, the front end 31 of the heater 30 may be inserted into a rear end of the cigarette 7.

A size of the through-hole 20*r* of the container 20 may correspond to a thickness of the front end 31 of the heater 30. For example, when the front end 31 of the heater 30 has a circular cross-section, the through-hole 20*r* may also have a circular cross-section and an inner diameter of the through-hole 20*r* may correspond to an outer diameter of the front end 31 of the heater 30. Thus, an inner surface of the through-hole 20*r* may keep contacting an outer surface of the front end 31 of the heater 30.

Thus, while the container 20 moves, the through-hole 20*r* may rake up a material attached to the outer surface of the front end 31 of the heater 30. Because the through-hole 20*r* of the container 20 and the front end 31 of the heater 30, the through-hole 20*r* and the front end 31 contacting each other, repeatedly relatively move with respect to each other, a coating layer including a wear-resistant material may be formed on the surface of the front end 31 of the heater 30. For example, the coating layer may include a material, such as metal, an alloy, ceramics, plastic, glass, etc.

Embodiments are not limited to the structure in which the inner surface of the through-hole 20*r* contacts the outer surface of the front end 31 of the heater 30 as described above. For example, the size of the through-hole 20*r* may be greater than the size of the front end 31 of the heater 30, and thus, the inner surface of the through-hole 20*r* may be apart from the outer surface of the front end 31 of the heater 30.

A rear end 32 of the heater 30 may be electrically connected to an electricity supply device 72 disposed at a rear end of the case 10, via an electric wire 71. A base 19 surrounding the electricity supply device 72 may be connected to the rear end of the case 10. When electricity of the electricity supply device 72 is supplied to the heater 30 in a state in which the cigarette 7 is inserted into the front end 31 of the heater 30, the heater 30 may be heated, and thus, the cigarette 7 may be heated.

FIG. 2 illustrates a state in which the cigarette 7 is mounted in the aerosol generating device. In order that the aerosol generating device generates cigarette smoke, the cigarette 7 may be inserted into a position of the through-hole 20*r* at the rear end of the container 20, as illustrated in FIG. 2. The total length of the heater 30 may be about 25 mm and a length of a portion of the front end 31 of the heater 30, the portion being inserted into the cigarette 7, may be about 12 mm. In this state, because a rear end of the cigarette 7 is inserted into the front end 31 of the heater 30, when electricity is supplied to the heater 30, the heater 30 may heat the cigarette 7 to generate cigarette smoke.

The case 10 may include a fixing portion 50 coupled to the rear end 32 of the heater 30 and fixing a position of the heater 30 with respect to the case 10. The fixing portion 50 may have an open upper end and a hollow cylindrical shape, and may have a space 50*v* inside for accommodating the container 20. The fixing portion 50 may have, at a rear end thereof, a cavity 50*r* into which the front end 31 of the heater 30 is inserted.

The front end 31 of the heater 30 may pass through the cavity 50*r* of the fixing portion 50. The heater 30 may have, at the outer surface thereof, a flange 30*p* that projects. Because the flange 30*p* is fixed to the fixing portion 50, the position of the heater 30 with respect to the case 10 may be fixed.

The elastic support portion 40 may be disposed between the fixing portion 50 and the container 20 and may elastically support the container 20 with respect to the case 10. In the illustrated embodiment, the elastic support portion 40 is realized as a cylindrical compressed coil spring. However, embodiments are not limited to this example of the elastic support portion 40. For example, the elastic support portion 40 may also be realized as a compressed cylinder using liquid or gas, rubber, etc.

The container 20 may include, at an end thereof, an expansion portion 20*f* extending to the outside. An inner diameter of the expansion portion 20*f* may be greater than an outer diameter of the cigarette 7. The case 10 may include an insertion portion 10*s* inserted between an inner wall surface 20*w* of the expansion portion 20*f* of the container 20 and an outer circumferential surface of the cigarette 7 and linearly extending in a direction in which the container 20 moves. That is, in a state in which the expansion portion 20*f* of the container 20 is inserted into a guide space 10*g* formed between the expansion portion 20*f* of the case 10 and the inner wall surface 20*w* of the case 10, the container 20 may linearly move in the longitudinal direction of the case 10.

The container 20 may include a stepped portion 29 formed at an outer surface of the expansion portion 20*f*, the surface facing toward the fixing portion 50. An end 40*f* of the elastic support portion 40 may be supported by the stepped portion 29 of the container 20 and the other end 40*r* of the elastic support portion 40 may be supported by the fixing portion 50.

Figure 3:
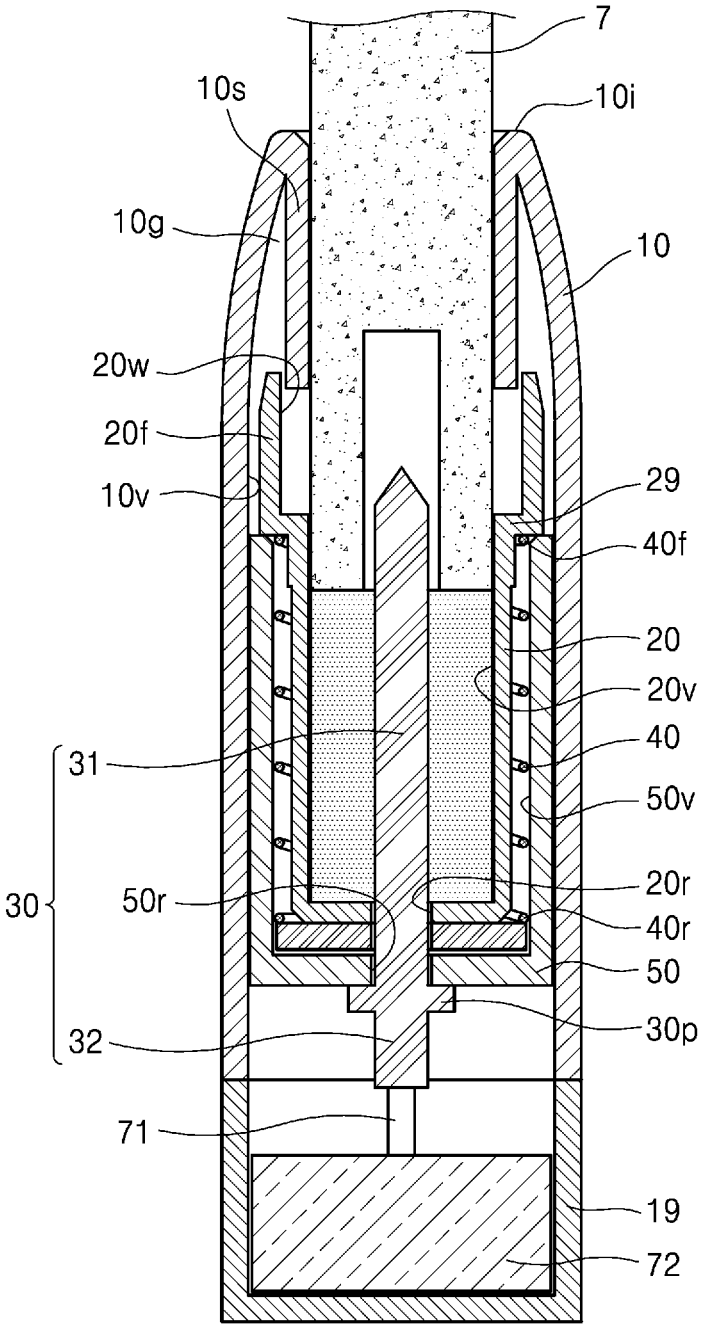
FIG. 3 is a cross-sectional view of an operational state of the aerosol generating device of FIG. 2, for separating the cigarette.
Figure 4:
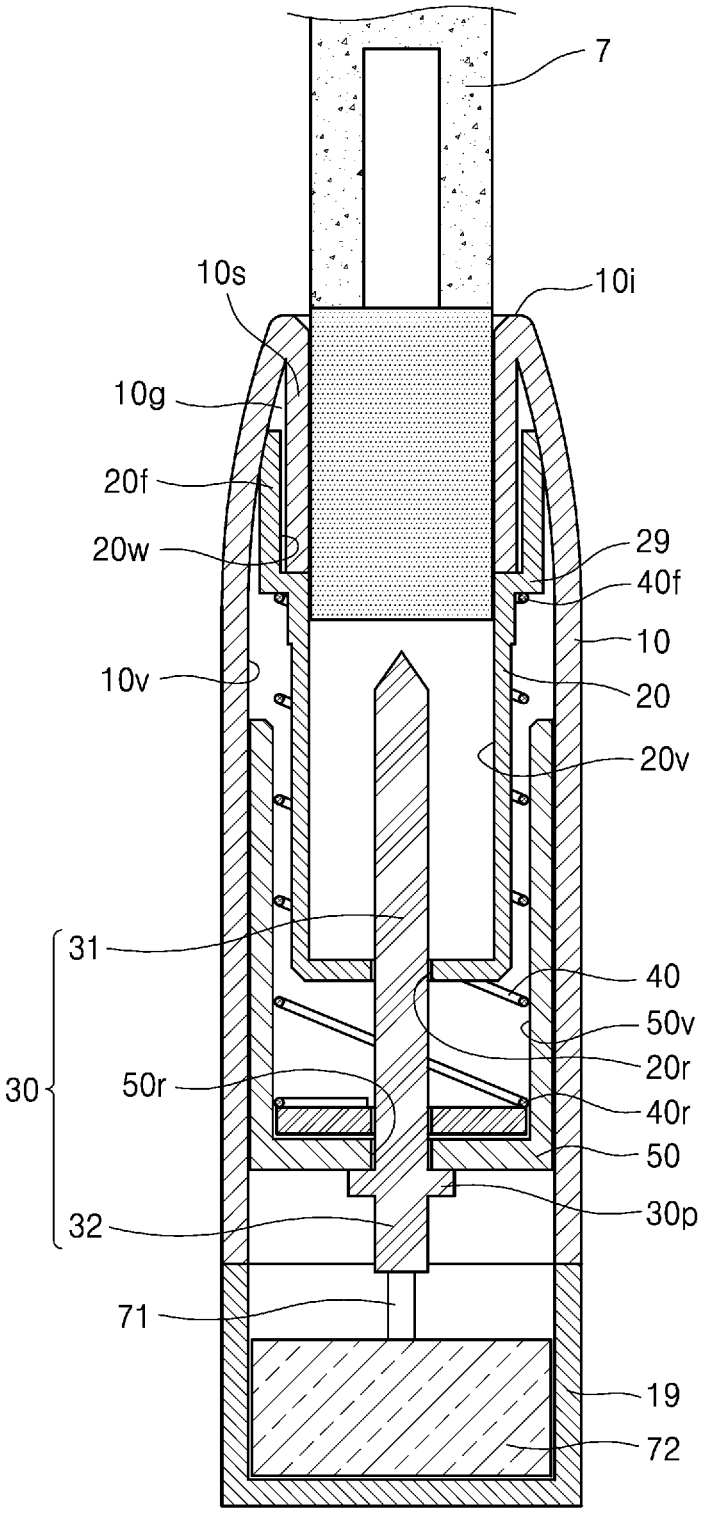
FIG. 4 is a cross-sectional view of an operational state in which the cigarette is separated from the aerosol generating device of FIG. 3.

FIG. 3 is a cross-sectional view of an operational state of the aerosol generating device of FIG. 2, for separating the cigarette and FIG. 4 is a cross-sectional view of an operational state in which the cigarette is separated from the aerosol generating device of FIG. 3.

After a user uses the aerosol generating device, the user may have to remove the cigarette 7 from the aerosol generating device. FIGS. 3 and 4 sequentially illustrate the operational states in which the cigarette is removed from the aerosol generating device.

FIG. 3 illustrates the operational state in which a user presses the cigarette 7 to remove the cigarette 7 from the aerosol generating device. When the user presses the cigarette 7 to separate the cigarette 7 from the aerosol generating device, the container 20 may press the elastic support portion 40 together with the cigarette 7 and may linearly move toward the rear end to a press position as illustrated in FIG. 3. While the cigarette 7 and the container 20 are pressed, the heater 30 may maintain a state in which the heater 30 is fixed to the fixing portion 50, and thus, a position of the heater 30 with respect to the case 10 may be maintained without a change.

Tobacco materials (residues) generated from the cigarette 7 while the cigarette 7 is heated by the heater 30 may be condensed and attached to contact surfaces of the heater 30 and the cigarette 7. While the cigarette 7 and the container 20 are pressed and linearly move to the press position as illustrated in FIG. 3, the heater 30 may maintain the position. The container 20 may move by about 5 mm to move to the press position. Based on this operation, the contact surfaces of the cigarette 7 and the heater 30 may be easily separated from each other, the contact surfaces being attached to each other due to the tobacco materials attached to the contact surfaces of the cigarette 7 and the heater 30.

When the user does not press and releases the cigarette 7 and the container 20 in the state illustrated in FIG. 3, the container 20 and the cigarette 7 may linearly move toward the front end due to a restoring force of the elastic support portion 40, so that the container 20 may move back to its initial position, which is an original position of the container 20, as illustrated in FIG. 4. Thereafter, the user holds the cigarette 7 and extracts the cigarette 7 from the accommodating space 20*v* of the container 20, to completely remove the cigarette 7 from the container 20 of the aerosol generating device.

According to the conventional aerosol generating device, when a cigarette is removed from the aerosol generating device, a user may simply withdraw the cigarette from the aerosol generating device, and thus, tobacco materials between the cigarette and a heater may frequently be attached to the heater.

However, according to the aerosol generating device according to the embodiment described above, before the cigarette 7 is removed from the aerosol generating device, the cigarette 7 and the container 20 may first be shifted to the press position, that is, the position to which the container 20 moves downwards to completely press the elastic support portion 40, as illustrated in FIG. 3.

While the container 20 and the cigarette 7 move to the press position, the heater 30 may remain in the fixed state so that the position of the heater 30 with respect to the case 10 is not changed. Thus, the contact surfaces between the heater 30 and the cigarette 7, the contact surfaces solidly contacting each other due to the tobacco materials, may be easily separated from each other.

Also, the tobacco materials stuck on the surface of the heater 30 may be removed from the heater 30 by the movement of the container 20 and the cigarette 7 to the press position as illustrated in FIG. 3 and the movement of the container 20 and the cigarette 7 back to the initial position as illustrated in FIG. 4. That is, while the container 20 and the cigarette 7 reach the press position illustrated in FIG. 3, the cigarette 7 may push the surface of the heater 30 and sweep the residues stuck on the surface of the heater 30. Also, when the container 20 pressed by the elastic support portion 40 moves back to its initial position illustrated in FIG. 4, the container 20 and the cigarette 7 may vibrate due to a press force of the elastic support portion 40, so that the vibration may be transferred between the surface of the heater 30 and the contact surface of the cigarette 7. Thus, the residues stuck on the surface of the heater 30 may be removed from the surface of the heater 30.

After the heater 30 is separated from the cigarette 7 through the operation described above, the user may hold the cigarette 7 and remove the cigarette 7 from the aerosol generating device. Thus, the residues stuck on the cigarette 7 may be easily discharged to the outside of the aerosol generating device, together with the cigarette 7.

FIG. 3 illustrates the removal of the cigarette 7 from the aerosol generating device. However, an operational state when a new cigarette 7 is mounted in the aerosol generating device may be similar to the operational state illustrated in FIG. 3. When, in order to mount the new cigarette 7 into the aerosol generating device, the user inserts the cigarette 7 into the empty accommodating space 20*v* of the container 20 and then presses the cigarette 7, the container 20 together with the cigarette 7 may move toward the rear end while pressing the elastic support portion 40.

When the elastic support portion 40 supporting the container 20 is not provided, the user may not know whether the cigarette 7 is completely inserted into the container 20, and thus, the user may forcibly keep pressing the cigarette 7.

However, according to the aerosol generating device according to the embodiment described above, while the user presses the cigarette 7, the elastic support portion 40 may apply a resistance force to the container 20 moving along the case 10. Thus, the user may feel a sense of the resistance transferred from the container 20 and the cigarette 7, and thus, may identify that the cigarette 7 is completely inserted into the container 20.

When the user releases the cigarette 7 after pressing the container 20 and the cigarette 7, the cigarette 7 and the container 20 may linearly move upwards to move back to their initial positions as illustrated in FIG. 2. In the state illustrated in FIG. 2, when the heater 30 heats the cigarette 7, tobacco smoke may be generated.

MODE OF DISCLOSURE

Figure 5:
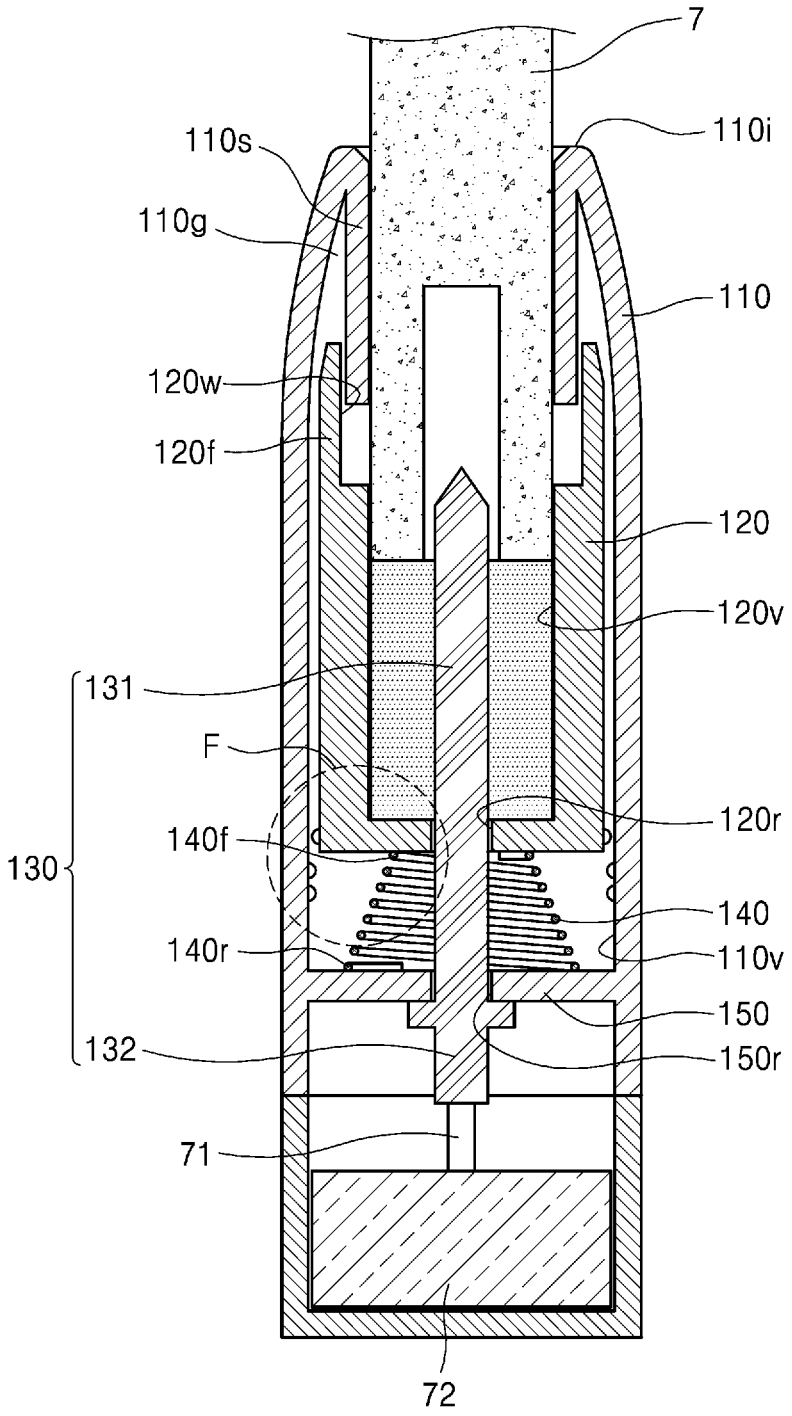
FIG. 5 is a cross-sectional view of an aerosol generating device according to another embodiment.

FIG. 5 is a cross-sectional view of an aerosol generating device according to another embodiment.

The aerosol generating device according to the embodiment illustrated in FIG. 5 may include a case 110, a container 120 mounted in the case 110 to be movable in a longitudinal direction of the case 110, wherein the container 120 includes an accommodating space 120*v* configured to accommodate the cigarette 7, a heater 130 disposed in the case 110 such that a front end 131 thereof is inserted into the accommodating space 120*v* of the container 120, wherein the heater 130 is configured to heat the cigarette 7, and an elastic support portion 140 configured to elastically support the container 120 with respect to the case 110.

The case 110 may form an exterior shape of the aerosol generating device and may accommodate and protect various components in an inner space 110*v* formed inside the case 110. The case 10 may have a hollow cylindrical shape and may have, at a front end thereof, an opening 110*i* which is open to the outside and through which the cigarette 7 may be inserted. The case 110 may be formed by including a plastic material not transferring electricity and heat or a metal material having a surface coated with a plastic material.

The container 120 may be mounted in the case 110 to be movable in the longitudinal direction of the case 110. The cigarette 7 may be formed to have a cylindrical shape and the container 120 and the case 110 may extend in a longitudinal direction of the cigarette 7 to correspond to the shape of the cigarette 7.

The container 120 may be formed to have a cylindrical shape which is empty inside and may have, at a front end and a rear end thereof, respectively, an opening through which the cigarette 7 is inserted and a through-hole 120*r* through which the front end 131 of the heater 130 passes. Also, the container 120 may have the accommodating space 120*v* configured to accommodate the cigarette 7.

While the container 120 is accommodated in the case 110, the container 120 may accommodate and support the cigarette 7 and may move in the longitudinal direction of the case 110 together with the cigarette 7. Thus, the container 120 is not detached outwards from the case 110.

The heater 130 configured to heat the cigarette 7 may be disposed in the case 110. The front end 131 of the heater 130 may be inserted into the container 120 through the through-hole 120*r* of the container 120 and when the cigarette 7 is accommodated in the container 120, the front end 131 of the heater 130 may be inserted into a rear end of the cigarette 7.

A rear end 132 of the heater 130 may be electrically connected to the electricity supply device 72 disposed at a rear end of the case 110, via the electric wire 71. When electricity of the electricity supply device 72 is supplied to the heater 130 in a state in which the cigarette 7 is inserted into the front end 131 of the heater 130, the heater 130 may be heated, and thus, the cigarette 7 may be heated.

The case 110 may include a fixing portion 150 coupled to the rear end 132 of the heater 130 and fixing a position of the heater 130 with respect to the case 110. The fixing portion 150 may have an open upper end and a hollow cylindrical shape, and may have a space 150*v* inside for accommodating the container 120. The fixing portion 150 may have, at a rear end thereof, a cavity 150*r* into which the front end 131 of the heater 130 is inserted.

The front end 131 of the heater 130 may pass through the cavity 150*r* of the fixing portion 150. The heater 130 may have, at an outer surface thereof, a flange that projects. Because the flange is fixed to the fixing portion 150, the position of the heater 130 with respect to the case 110 may be fixed.

The elastic support portion 140 may be disposed between the fixing portion 150 and the container 120 and may elastically support the container 120 with respect to the case 110. In the illustrated embodiment, the elastic support portion 140 is realized as a compressed coil spring having a cone- or ladder-shaped cross-section. However, embodiments are not limited to this example of the elastic support portion 140. For example, the elastic support portion 140 may also be realized as a compressed cylinder using liquid or gas, rubber, etc.

The container 120 may include, at an end thereof, an expansion portion 120*f* extending to the outside. An inner diameter of the expansion portion 120*f* may be greater than an outer diameter of the cigarette 7. The case 110 may include an insertion portion 110*s* inserted between an inner wall surface 120*w* of the expansion portion 120*f* of the container 120 and an outer circumferential surface of the cigarette 7 and linearly extending in a direction in which the container 120 moves. That is, in a state in which the expansion portion 120*f* of the container 120 is inserted into a guide space 110*g* formed between the expansion portion 120*f* of the case 110 and the inner wall surface 120*w* of the case 110, the container 120 may linearly move in the longitudinal direction of the case 110.

An end 140*f* of the elastic support portion 140 may be supported by a lower surface of the container 120 and the other end 140*r* of the elastic support portion 140 may be supported by the fixing portion 150.

Figure 6:
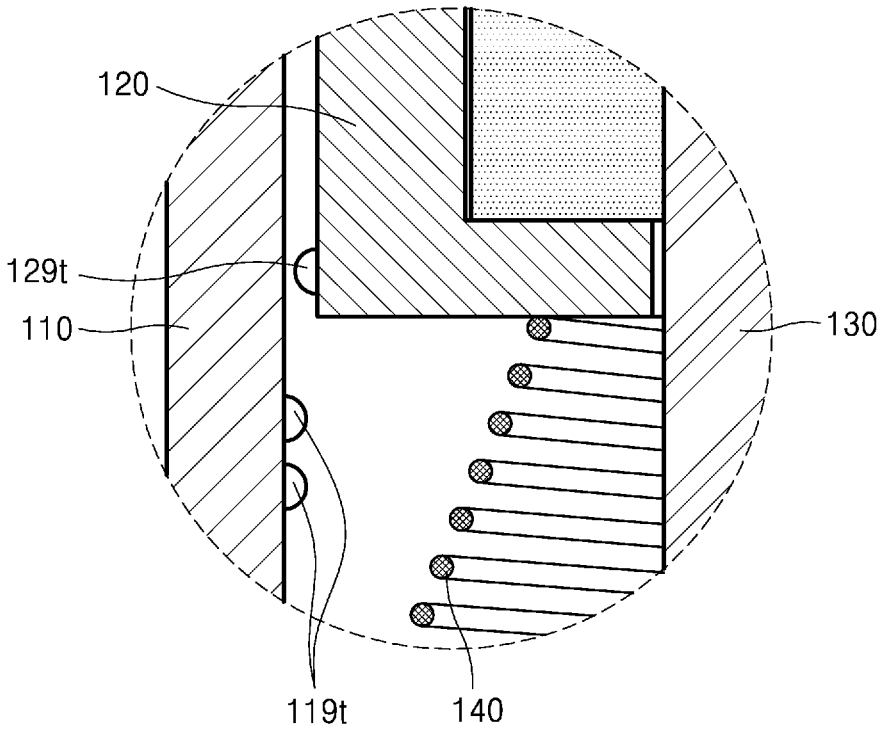
FIG. 6 is an enlarged cross-sectional view of a portion of the aerosol generating device according to the embodiment illustrated in FIG. 5.
Figure 7:
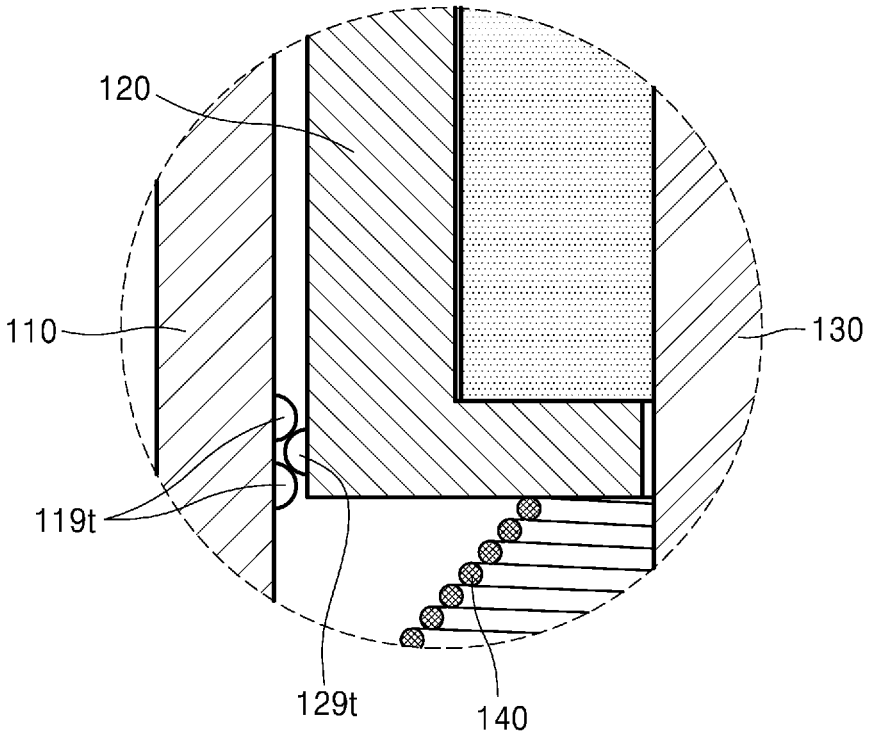
FIG. 7 is a cross-sectional view of an operational state of the aerosol generating device according to the embodiment illustrated in FIG. 6.

FIG. 6 is an enlarged cross-sectional view of a portion of the aerosol generating device according to the embodiment illustrated in FIG. 5 and FIG. 7 is a cross-sectional view of an operational state of the aerosol generating device according to the embodiment illustrated in FIG. 6. FIGS. 6 and 7 illustrate enlarged portions F of FIG. 5.

The aerosol generating device may include a stopper disposed between the container 120 and the case 110 and applying resistance in a direction opposite to a direction in which the container 120 moves. The stopper may include a moving projection 129*t* projecting from an outer surface of the container 120, and fixing projections 119*t* projecting from an inner surface of the case 110.

When a user presses the container 120 downwards, the moving projection 129*t* of the container 120 may move downwards together with the container 120, thereby approaching the fixing projections 119*t*, as illustrated in FIG. 6.

When the user keeps pressing the container 120, the moving projection 129*t* of the container 120 may be inserted between the fixing projections 119*t* of the case 110, as illustrated in FIG. 7. Thus, due to the coupling between the moving projection 129*t* and the fixing projections 119*t*, the movement of the container 120 may be restricted.

When sizes of the moving projection 129*t* and the fixing projection 119*t* are large and a force by which the two fixing projections 119*t* fix the moving projection 129*t* is greater than the pressing force of the elastic support portion 140, the stopper may keep the container 120 at a press position illustrated in FIG. 7. In this case, in order to move the container 120 upwards from the press position illustrated in FIG. 7, the user may apply force to the container 120 to release the coupling between the moving projection 129*t* and the fixing projections 119*t*. When the moving projection 129*t* is released from the fixing projections 119*t*, the container 120 may move upwards due to a restoring force of the elastic support portion 140.

When sizes of the moving projection 129*t* and the fixing projection 119*t* are large and a force by which the two fixing projections 119*t* fix the moving projection 129*t* is less than the pressing force of the elastic support portion 140, the stopper may not keep the container 120 at the press position illustrated in FIG. 7 and may only apply a resistance force for the downward movement of the container 120. That is, because the user may feel a sense of the resistance by hand in the process in which the container 120 reaches the press position illustrated in FIG. 7 and the moving projection 129*t* is inserted between the two fixing projections 119*t*, the user may identify that the container 120 is sufficiently pressed.

According to the embodiment described above, two fixing projections 119*t* are illustrated. However, embodiments are not limited to this number, the shape, or the size of the fixing projections 119*t*. For example, only one fixing projection 119*t* may be mounted, but the moving projection 129*t* and the fixing projection 119*t* may be formed to be sufficiently large so that the moving projection 129*t* may not pass through the fixing projection 119*t*. In this case, the moving projection 129*t* and the fixing projection 119*t* may restrict a linear movement of the container 120 such that the container 120 may not move beyond the press position.

Embodiments illustrated in FIGS. 8 through 20A and 20F provide a modified aerosol generating device and a method of generating an aerosol which may be applied to the aerosol generating device according to the embodiments illustrated in FIGS. 1 through 7.

In FIGS. 8 through 20F, reference numerals referring to components are independently used regardless of the reference numerals used in FIGS. 1 through 7. Thus, it should be understood that the reference numerals of the components in FIGS. 1 through 7 and the reference numerals of the components in FIGS. 8 through 20F are independently used for the different components.

Figure 8:
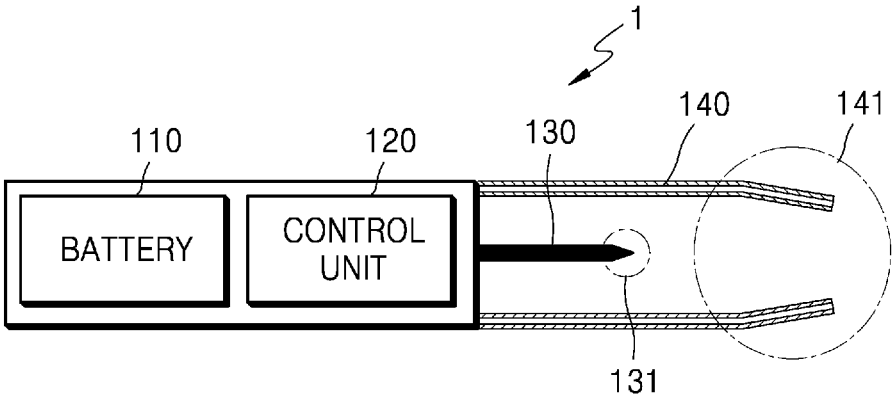
FIG. 8 is a block diagram showing an example of an aerosol generating apparatus according to another embodiment.

FIG. 8 is a block diagram showing an example of an aerosol generating apparatus according to another embodiment.

Referring to FIG. 8, aerosol generating device 1, hereinafter, referred to as "holder", includes battery 110, control unit 120, and heater 130. The holder 1 also includes an inner space formed by a casing 140. A cigarette may be inserted into the inner space of the holder 1.

FIG. 8 shows holder 1 with some elements related to the embodiment. Therefore, it will be understood by one of ordinary skill in the art that the holder 1 may further include additional conventional elements in addition to elements shown in FIG. 8.

When a cigarette is inserted into the holder 1, the holder 1 heats the heater 130. The temperature of an aerosol generating material in the cigarette is raised by the heated heater 130, and thus aerosol is generated. The generated aerosol is delivered to a user through a cigarette filter. However, even when a cigarette is not inserted into the holder 1, the holder 1 may heat the heater 130.

The casing 140 may be detached from the holder 1. For example, when a user rotates the casing 140 clockwise or counterclockwise, the casing 140 may be detached from the holder 1.

The diameter of a hole formed by a terminal end 141 of the casing 140 may be smaller than the diameter of a space formed by the casing 140 and the heater 130. In this case, the hole may serve as a guide for a cigarette inserted into the holder 1.

The battery 110 supplies power used for the holder 1 to operate. For example, the battery 110 may supply power for heating the heater 130 and supply power for operating the control unit 120. In addition, the battery 110 may supply power for operating a display, a sensor, a motor, and the like installed in the holder 1.

The battery 110 may be a lithium iron phosphate ($LiFePO_4$) battery, but is not limited to the example described above. For example, the battery 110 may be a lithium cobalt oxide ($LiCoO_2$) battery, a lithium titanate battery, etc.

Also, the battery 110 may have a cylindrical shape having a diameter of 10 mm and a length of 37 mm, but is not limited thereto. The capacity of the battery 110 may be 120 mAh or more, and the battery 110 may be a rechargeable battery or a disposable battery. For example, when the battery 110 is rechargeable, the charging rate (C-rate) of the battery 110 may be 10 C and the discharging rate (C-rate) may be 16 C to 20 C. However, the present disclosure is not limited thereto. Also, for stable use, the battery 110 may be manufactured, such that 80% or more of the total capacity may be ensured even when charging/discharging are performed 8000 times.

Here, it may be determined whether the battery 110 is fully charged or completely discharged based on a level of power stored in the battery 110 as compared to the entire capacity of the battery 110. For example, when power stored in the battery 110 is equal to or more than 95% of the total capacity, it may be determined that the battery 110 is fully charged. Furthermore, when power stored in the battery 110 is 10% or less of the total capacity, it may be determined that the battery 110 is completely discharged. However, the criteria for determining whether the battery 110 is fully charged or completely discharged are not limited to the above examples.

The heater 130 is heated by power supplied from the battery 110. When a cigarette is inserted into the holder 1, the heater 130 is located inside the cigarette. Therefore, the heated heater 130 may raise the temperature of an aerosol generating material in the cigarette.

The shape of the heater 130 may be a combination of a cylinderical shape and a conical shape. For example, the heater 130 may have a diameter of 2 mm, a length of 23 mm, and a cylindrical shape. Also, end 131 of heater 130 may be processed to have an acute angle edge. But, the embodiments are not limited to these features. In other words, the heater 130 may have any shape as long as the heater 130 may be inserted into the cigarette. In addition, only a portion of the heater 130 may be heated. For example, if the heater 130 has a length of 23 mm, only a part of the heater 130, 12 mm distanced from the end 131, is heated, while other part of the heater 130 is not heated.

The heater 130 may be an electrical resistive heater. For example, the heater 130 includes an electrically conductive track, and the heater 130 may be heated as a current flows through the electrically conductive track.

For stable use, the heater 130 may be supplied with power according to the specifications of 3.2 V, 2.4 A, and 8 W, but is not limited thereto. For example, when power is supplied to the heater 130, the surface temperature of the heater 130 may rise to 400° C. or higher. The surface temperature of the heater 130 may rise to about 350° C. before 15 seconds after the power supply to the heater 130 starts.

The holder 1 may have a special temperature sensor. Alternatively, the holder 1 may not be provided with a temperature sensing sensor, and the heater 130 may serve as a temperature sensing sensor. For example, the heater 130 may further include a second electrically conductive track for sensing temperature in addition to a first electrically conductive track for sensing heating temperature.

For example, when a voltage applied to the second electrically conductive track and a current flowing through the second electrically conductive track are measured, a resistance R may be determined. At this time, a temperature T of the second electrically conductive track may be determined by Equation 1 below.

$$R=R_0\{1+\alpha(T-T_0)\} \quad \text{[Equation 1]}$$

In Equation 1, R denotes a current resistance value of the second electrically conductive track, $R_0$ denotes a resistance value at a temperature $T_0$ (e.g., 0° C.), and a denotes a resistance temperature coefficient of the second electrically conductive track. Since conductive materials (e.g., metals) have inherent resistance temperature coefficients, a may be determined in advance according to a conductive material constituting the second electrically conductive track. Therefore, when the resistance R of the second electrically conductive track is determined, the temperature T of the second electrically conductive track may be calculated according to Equation 1.

The heater 130 may include at least one electrically conductive track (a first electrically conductive track and a second electrically conductive track). For example, the heater 130 may include, but is not limited to, two first electrically conductive tracks and one or two second electrically conductive tracks.

An electrically conductive track includes an electrical resistive material. For example, an electrically conductive track may include a metal. In another example, an electrically conductive track may include an electrically conductive ceramic material, a carbon, a metal alloy, or a composite of a ceramic material and a metal.

In addition, the holder 1 may include both an electrically conductive track, which serves as temperature sensing sensors, and a temperature sensing sensor.

The control unit 120 controls the overall operation of the holder 1. Specifically, the control unit 120 controls not only operations of the battery 110 and the heater 130, but also operations of other components included in the holder 1. The control unit 120 may also check the status of each of the components of the holder 1 and determine whether the holder 1 is in an operable state.

The control unit 120 includes at least one processor. A processor may be implemented as an array of a plurality of logic gates or may be implemented as a combination of a general purpose microprocessor and a memory in which a program executable in the microprocessor is stored. It will be understood by one of ordinary skill in the art that the present disclosure may be implemented in other forms of hardware.

For example, the control unit 120 may control the operation of the heater 130. The control unit 120 may control an amount of power supplied to the heater 130 and a time for supplying the power, such that the heater 130 may be heated to a predetermined temperature or maintained at a proper temperature. The control unit 120 may also check the status of the battery 110 (e.g., the remaining amount of the battery 110) and generate a notification signal as occasions demand.

Also, the control unit 120 may check the presence or absence of a user's puff, check the strength of the puff, and count the number of puffs. Also, the control unit 120 may continuously check the time during which the holder 1 is operating. The control unit 120 may also check whether a cradle 2 to be described below is coupled with the holder 1 and control the operation of the holder 1 based on whether the cradle 2 is coupled with or separated from and the holder 1.

Meanwhile, the holder 1 may further include general-purpose components other than the battery 110, the control unit 120, and the heater 130.

For example, the holder 1 may include a display capable of outputting visual information or a motor for outputting tactile information. For example, when a display is included in the holder 1, the control unit 120 may provide a user information about the state of the holder 1 (e.g., availability of the holder, etc.), information about the heater 130 (e.g., start of preheating, progress of preheating, completion of preheating, etc.), information about the battery 110 (e.g., remaining power of the battery 110, availability, etc.), information about resetting of the holder 1 (e.g., reset timing, reset progress, reset completion, etc.), information about cleaning of the holder 1 (e.g., cleaning timing, cleaning progress, cleaning completion, etc.), information about charging of the holder 1 (e.g., need of charging, charging progress, charging completed, etc.), information about puff (e.g., the number of puffs, notification of expected completion of puffs, etc.), or information about safety (e.g., time of use, etc.) via the display. In another example, when a motor is included in the holder 1, the control unit 120 may transmit the above-described information to a user by generating a vibration signal by using the motor.

The holder 1 may also include a terminal coupled with at least one input device (e.g., a button) and/or the cradle 2 through which a user may control the function of the holder 1. For example, a user may perform various functions by using the input device of the holder 1. By adjusting the number of times a user presses the input device (e.g., once, twice, etc.) or the time during which the input device is being pressed (e.g., 0.1 second, 0.2 second, etc.), a desired function from among a plurality of functions of the holder 1 may be executed. As a user manipulates the input device, the holder 1 may perform a function of preheating the heater 130, a function of regulating the temperature of the heater 130, a function of cleaning the space in which a cigarette is inserted, a function of checking whether the battery 110 is in an operable state, a function of displaying the remaining power (available power) of the battery 110, a function of resetting the holder 1, etc. However, the functions of the holder 1 are not limited to the examples described above.

The holder 1 may also include a puff detecting sensor, a temperature sensing sensor, and/or a cigarette insertion detecting sensor. For example, the puff detecting sensor may be implemented by a conventional pressure sensor, and cigarette insertion detecting sensor may be implemented by a general capacitance sensor or electric resistive sensor. Also, the holder 1 may be fabricated to have a structure in which the outside air may flow in/out even in the state where the cigarette is inserted.

Figure 9A:
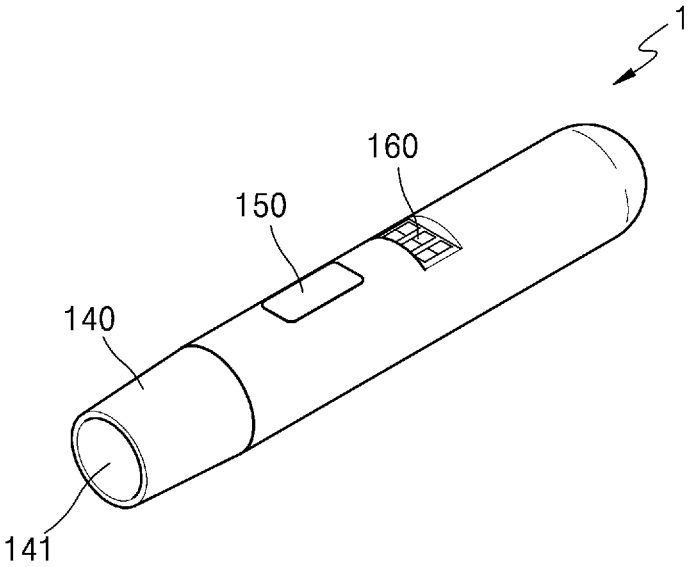
FIGS. 9A and 9B are diagrams showing various views of an example of a holder.
Figure 9B:
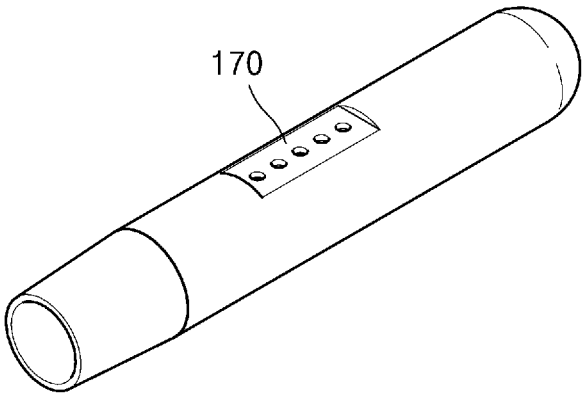

FIGS. 9A and 9B are diagrams showing various views of an example of a holder.

FIG. 9A is a diagram showing an example of holder 1 seen from a first direction. As shown in FIG. 9A, holder 1 may be fabricated to have a cylindrical shape, but not limited thereto. The casing 140 of the holder 1 may be separated by an action of a user and a cigarette may be inserted into an terminal end 141 of the casing 140. The holder 1 may also include a button 150 for a user to control the holder 1 and a display 160 for outputting an image.

FIG. 9B is a diagram showing other example of holder 1 seen from a second direction. The holder 1 may include a terminal 170 coupled with the cradle 2. As the terminal 170 of the holder 1 is coupled with a terminal 260 of the cradle 2, the battery 110 of the holder 1 may be charged by power supplied by a battery 210 of the cradle 2. Also, the holder 1 may be operated by power supplied from the battery 210 of the cradle 2 through the terminal 170 and the terminal 260 and a communication (transmission/reception of signals) may be performed between the holder 1 and the cradle 2 through the terminal 170 and the terminal 260. For example, the terminal 170 may include four micro pins, but the present disclosure is not limited thereto.

Figure 10:
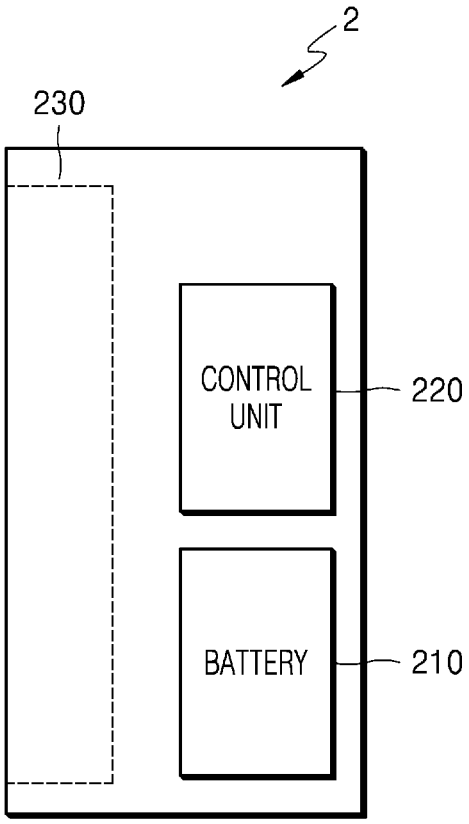
FIG. 10 is a diagram showing an example configuration of a cradle.

FIG. 10 is a diagram showing an example configuration of a cradle.

In FIG. 10, the cradle 2 includes a battery 210 and a control unit 220. The cradle 2 also includes an inner space 230 into which the holder 1 may be inserted. For example, the inner space 230 may be formed on one side of the cradle 2. Therefore, the holder 1 may be inserted and fixed in the cradle 2 even when the cradle 2 does not include a separate lid.

FIG. 10 shows the cradle 2 having some elements related to the embodiments. Therefore, it will be understood by one of ordinary skill in the art that the cradle 2 may further include additional conventional elements in addition to the elements shown in FIG. 10.

The battery 210 provides power used to operate the cradle 2. In addition, the battery 210 may supply power for charging the battery 110 of the holder 1. For example, when the holder 1 is inserted into the cradle 2 and the terminal 170 of the holder 1 is coupled with the terminal 260 of the cradle 2, the battery 210 of the cradle 2 may supply power to the battery 110 of the holder 1.

Also, when the holder 1 is coupled with the cradle 2, the battery 210 may supply power used for the holder 1 to operate. For example, when the terminal 170 of the holder 1 is coupled with the terminal 260 of the cradle 2, the holder 1 may operate by using power supplied by the battery 210 of the cradle 2 regardless of whether the battery 110 of the holder 1 is discharged or not.

The examples of type of battery 210 may be the same as the battery 110 shown in FIG. 8. The battery 210 may have capacity bigger than the capacity of battery 110. For example, the battery may have capacity over 3000 mAh. But, the capacity of the battery 210 should not be limited to the above example.

The control unit 220 generally controls the overall operation of the cradle 2. The control unit 220 may control the overall operation of all the configurations of the cradle 2. The control unit 220 may also determine whether the holder 1 is coupled with the cradle 2 and control the operation of the cradle 2 according to coupling or separation of the cradle 2 and the holder 1.

For example, when the holder 1 is coupled with the cradle 2, the control unit 220 may supply power of the battery 210 to the holder 1, thereby charging the battery 110 or heating the heater 130. Therefore, even when remaining power of the battery 110 is low, a user may continuously smoke by coupling the holder 1 with the cradle 2.

The control unit 120 includes at least one processor. A processor may be implemented as an array of a plurality of logic gates or may be implemented as a combination of a general purpose microprocessor and a memory in which a program executable in the microprocessor is stored. It will be understood by one of ordinary skill in the art that the present disclosure may be implemented in other forms of hardware.

Meanwhile, the cradle 2 may further include general-purpose components other than the battery 210 and the control unit 220. For example, cradle 2 may include a display capable of outputting visual information. For example, when the cradle 2 includes a display, the control unit 220 generates a signal to be displayed on the display, thereby informing a user information regarding the battery 210 (e.g., the remaining power of the battery 210, availability of the battery 210, etc.), information regarding resetting of the cradle 2 (e.g., reset timing, reset progress, reset completion, etc.), information regarding cleaining of the holder 1 (e.g., cleaning timing, cleaning necessity, cleaining progress, cleaining completion, etc.), information regarding charging of the cradle 2 (e.g., charging necessity, charging progress, charging completion, etc.).

The cradle 2 may also include at least one input device (e.g., a button) for a user to control the function of the cradle 2, a terminal 260 to be coupled with the holder 1, and/or an interface for charging the battery 210 (e.g., an USB port, etc.).

For example, a user may perform various functions by using the input device of the cradle 2. By controlling the number of times that a user presses the input device or a period of time for which the input device is pressed, a desired function from among the plurality of functions of the cradle 2 may be executed. As a user manipulates the input device, the cradle 2 may perform a function of preheating the heater 130, a function of regulating the temperature of the heater 130, a function of cleaning the space in which a cigarette is inserted, a function of checking whether the cradle 2 is in an operable state, a function of displaying the remaining power (available power) of the battery 210 of the cradle 2, a function of resetting the cradle 2, etc. However, the functions of the cradle 2 are not limited to the examples described above.

Figure 11A:
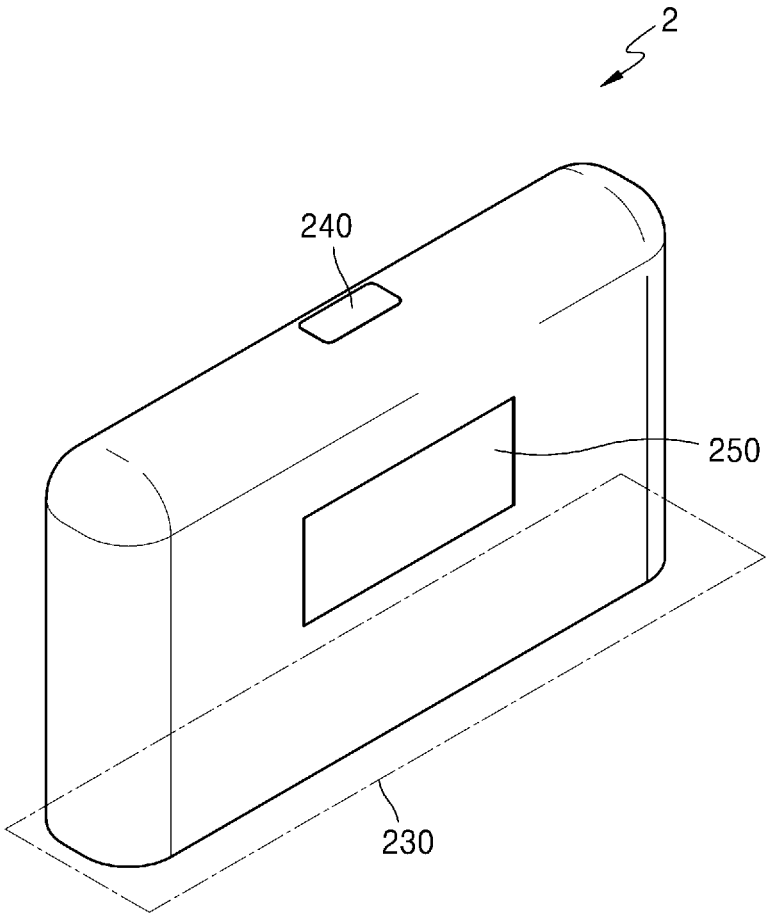
FIGS. 11A and 11B are diagrams showing various views of an example of a cradle.
Figure 11B:
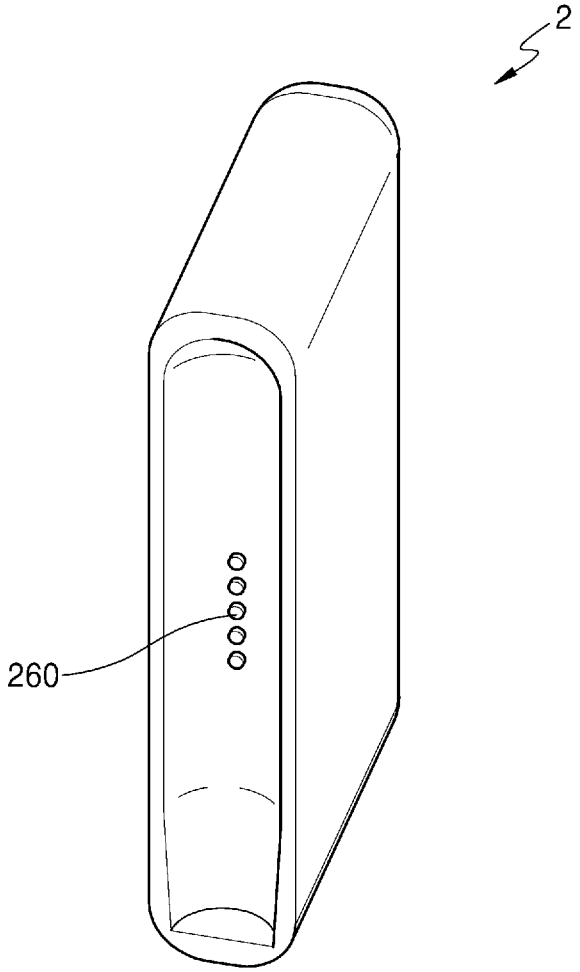

FIGS. 11A and 11B are diagrams showing various views of an example of a cradle.

FIG. 11A is a diagram showing an example of the cradle 2 seen from a first direction. The inner space 230 into which the holder 1 may be inserted may be formed on one side of the cradle 2. Also, the holder 1 may be inserted and fixed in the cradle 2 even when the cradle 2 does not include a separate fixing unit like a lid. The cradle 2 may also include a button 240 for a user to control the cradle 2 and a display 250 for outputting an image.

FIG. 11B is a diagram showing other example of the cradle 2 seen from a second direction. The cradle 2 may include a terminal 260 to be coupled with the inserted holder 1. The battery 110 of the holder 1 may be charged by power supplied by the battery 210 of the cradle 2 as the terminal 260 is coupled with the terminal 170 of the holder 1. Also, the holder 1 may be operated by power supplied from the battery 210 of the cradle 2 through the terminal 170 and the terminal 260 and transmission/reception of signals may be performed between the holder 1 and the cradle 2 through the terminal 170 and the terminal 260. For example, the terminal 260 may include four micro pins, but the present disclosure is not limited thereto.

As above explained along with FIGS. 8 and 11B, holder 1 may be inserted into internal space 230. The holder 1 may be completely inserted into the cradle 2 or may be tilted while being inserted into the cradle 2. Hereinafter, referring to FIGS. 12 to 14B, examples of inserting holder 1 into cradle 2 will be explained.

Figure 12:
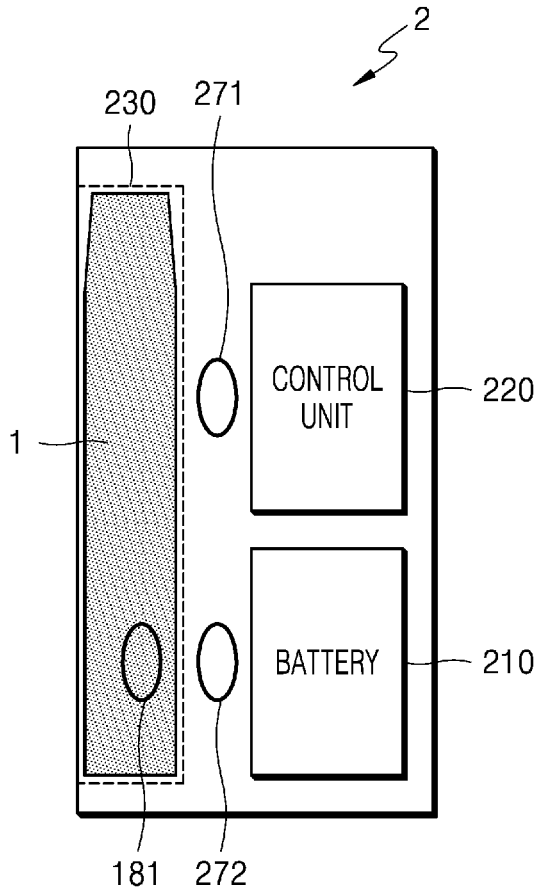
FIG. 12 is a diagram showing an example in which a holder is inserted into a cradle.

FIG. 12 is a diagram showing an example in which a holder is inserted into a cradle.

FIG. 12 shows an example where the holder 1 is inserted into the cradle 2. Since the space 230 into which the holder 1 is to be inserted is present on one side surface of the cradle 2, the inserted holder 1 may not be exposed to the outside by the other side surfaces of the cradle 2. Therefore, the cradle 2 may not include another component (e.g., a lid) for not exposing the holder 1 to the outside.

The cradle 2 may include at least one attaching member 271 and/or 272 to increase attachment strength with the holder 1. Also, at least one attaching member 181 may be included in the holder 1 as well. Here, attaching members 181, 271, and 272 may be magnets, but are not limited thereto. In FIG. 12, for a purpose of a simple explanation, it is shown that the holder 1 includes only one attaching member 181 and the cradle 2 includes two the attaching members 271 and 272. But, the number of the attaching members 181, 271 and 272 are not limited.

The holder 1 may include the attaching member 181 at a first position and the cradle 2 may include the attaching members 271 and 272 at a second position and a third position, respectively. In this case, the first position and the third position may be positions facing each other when the holder 1 is inserted into the cradle 2.

Since the attaching members 181, 271, and 272 are included in the holder 1 and the cradle 2, the holder 1 and the cradle 2 may be fastened to each other more strongly even when the holder 1 is inserted into one side surface of the cradle 2. In other words, as the holder 1 and the cradle 2 further include the attaching members 181, 271, and 272 in addition to the terminals 170 and 260, the holder 1 and the cradle 2 may be fastened to each other more strongly.

Therefore, even when there is no separate component (e.g., a lid) in the cradle 2, the inserted holder 1 may not be easily separated from the cradle 2.

Also, when the control unit 220 also determines that the holder 1 is completely inserted into the cradle 2 through the terminals 170 and 260 and/or the attaching members 181, 271, and 272, the control unit 220 may charge the battery 110 of the holder 1 by using power of the battery 210.

Figure 13:
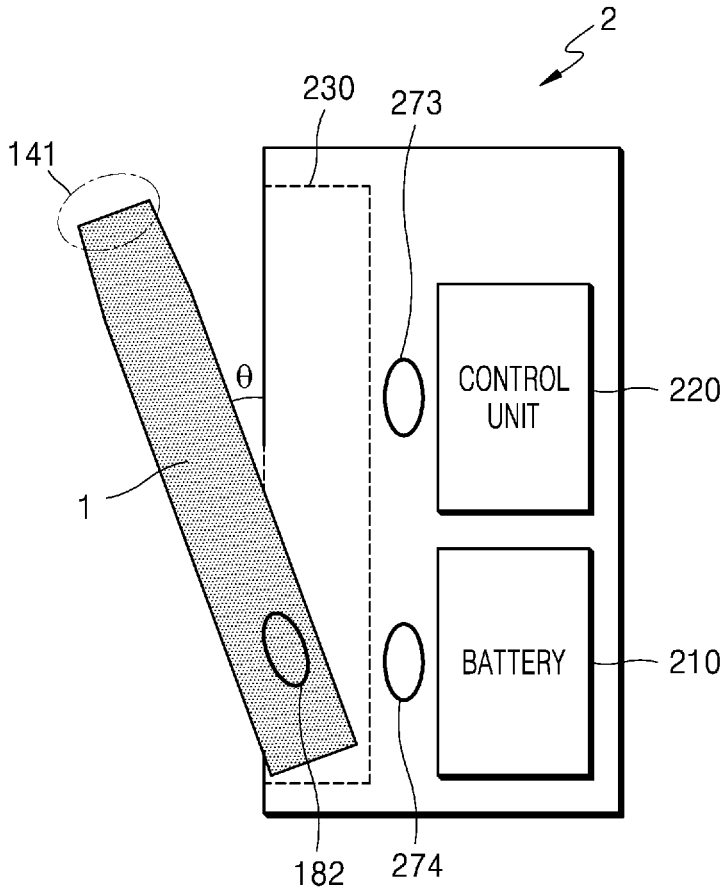
FIG. 13 is a diagram showing an example in which a holder is tilted while being inserted into a cradle.

FIG. 13 is a diagram showing an example in which a holder is tilted while being inserted into a cradle.

FIG. 13 shows that the holder 1 is tilted inside the cradle 2. Here, the term 'tilting' indicates that the holder 1 is inclined at a certain angle in a state while the holder 1 is being inserted into the cradle 2.

If the holder 1 is fully tilted inside the cradle 2 as shown in FIG. 12, the user may not smoke. In other words, once the holder 1 is completely inserted into the cradle 2, a cigarette may not be inserted into the holder 1. Therefore, when the holder 1 is completely inserted into the cradle 2, a user may not smoke.

If the holder 1 is tilted as shown in FIG. 13, end 141 of the holder 1 is exposed to outside. Therefore, the user may insert a cigarette into the terminal end 141 and smoke generated aerosol. A sufficient tilting angle θ may be secured to prevent a cigerette from being bent or damaged when the cigarette is inserted into the terminal end 141 of the holder 1. For example, the holder 1 may be tilted so that a whole part of cigarette insertion opening included in the end 141 may be exposed to the outside. For example, tilting angle θ may range between 0 to 180 degrees, preferably between 10 degrees and 90 degrees. More preferably, tilting angle θ may range between 10 to 20 degrees, between 10 to 30 degrees, between 10 to 40 degrees, between 10 to 50 degrees, or between 10 to 60 degrees.

Also, even when the holder 1 is tilted, the terminal 170 of the holder 1 and the terminal 260 of the cradle 2 are coupled with each other. Therefore, the heater 130 of the holder 1 may be heated by power supplied by the battery 210 of the cradle 2. Therefore, the holder 1 may generate aerosol by using the battery 210 of the cradle 2 even when the remaining power of the battery 110 of the holder 1 is low or the battery 110 of the holder 1 is completely discharged.

FIG. 13 shows an example where the holder includes one attaching member 182 and the cradle 2 includes two attaching member 273, 274. For example, each position of the attaching members 182, 273, 274 is as shown in FIG. 12. Assuming that the attaching members 182, 273, and 274 are magnets, the magnetic strength of the attaching member 274 may be greater than the magnetic strength of the attaching member 273. Therefore, the holder 1 may not be completely separated from the cradle 2 due to the attaching member 182 and the attaching member 274 even when the holder 1 is tilted.

Also, when it is determined that the holder 1 titled through the terminals 170 and 260 and/or the attaching members 181, 271, and 272, the control unit 220 may heat the heater 130 of the holder 1 or charge the battery 110 by using power of the battery 210.

Figure 14A:
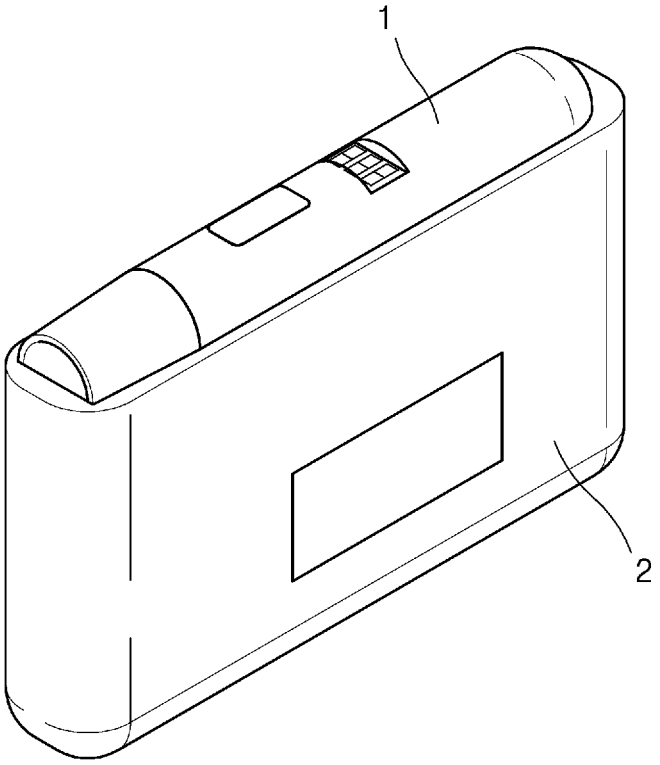
FIGS. 14A to 14B are diagrams showing examples in which a holder is inserted into a cradle.
Figure 14B:
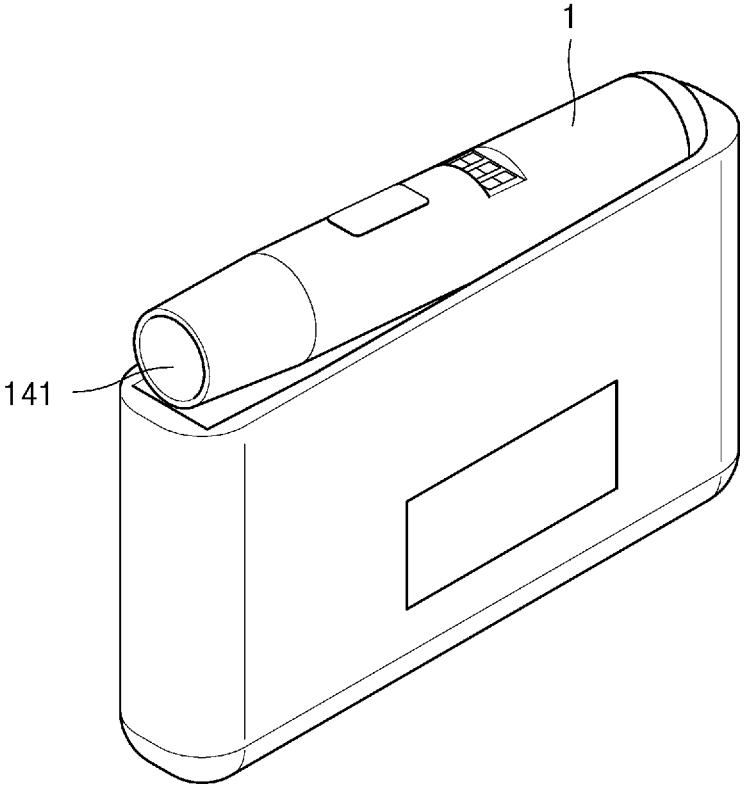

FIGS. 14A to 14B are diagrams showing examples in which a holder is inserted into a cradle.

FIG. 14A shows an example where the holder 1 is fully inserted into the cradle 2. The cradle 2 may be fabricated to provide the sufficient inner space 230 of the cradle 2 to minimize the contact of a user with the holder 1 when the holder 1 is completely inserted into the cradle 2. When the holder 1 is completely inserted into the cradle 2, the control unit 220 supplies power of the battery 210 to the holder 1, such that the battery 110 of the holder 1 is charged.

FIG. 14B shows other example where the holder 1 is tilted while in the state of being inserted into the cradle 2. When the holder 1 is tilted, the control unit 220 supplies power of the battery 210 to the holder 1, such that the battery 110 of the holder 1 is charged or the heater 130 of the holder 1 is heated.

Figure 15:
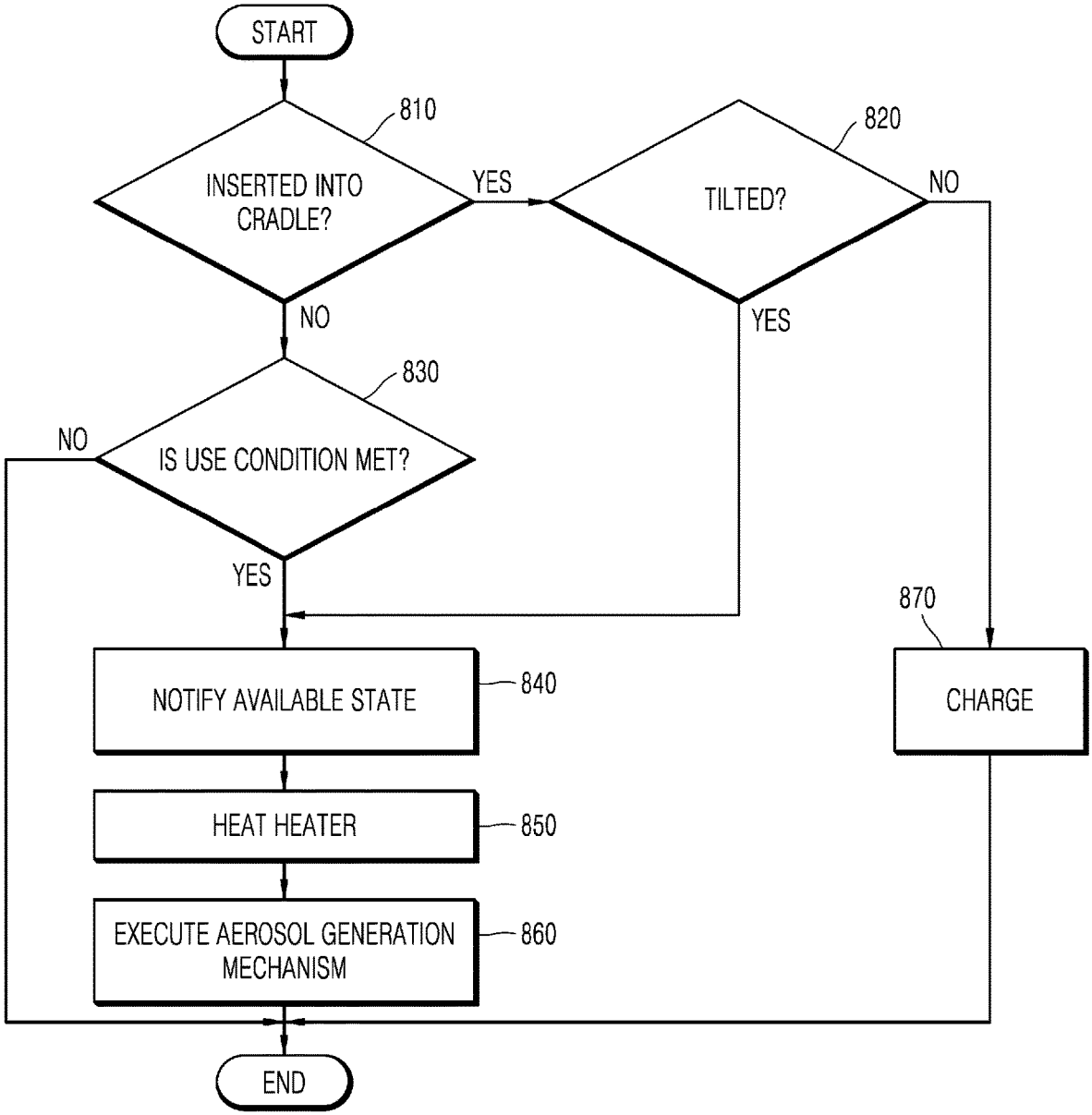
FIG. 15 is a flowchart for describing an example in which a holder and a cradle operates.

FIG. 15 is a flowchart for describing an example in which a holder and a cradle operate.

A method for generating aerosols shown in FIG. 15 includes operations that are performed in a time-series manner by the holder 1 shown in FIG. 8 or the cradle 2 shown in FIG. 10. Therefore, it will be understood that the descriptions given above with respect to the holder 1 shown in FIG. 8 and the cradle 2 shown in FIG. 10 also apply to the method of FIG. 15, even when the descriptions are omitted below.

In operation 810, the holder 1 determines whether it is inserted in the cradle 2. For example, the control unit 120 may determine whether the holder 1 is inserted into the cradle 2 based on whether the terminals 170 and 260 of the holder 1 and the cradle 2 are connected to each other and/or whether the attaching members 181, 271, and 272 are operating.

When the holder 1 is inserted into the cradle 2, the method proceeds to operation 820. When the holder 1 is separated from the cradle 2, the method proceeds to operation 830.

In operation 820, the cradle 2 determines whether the holder 1 is tilted. For example, the control unit 220 may determine whether the holder 1 is inserted into the cradle 2 based on whether the terminals 170 and 260 of the holder 1 and the cradle 2 are connected to each other and/or whether attaching members 182, 273, and 274 are operating.

Although it is described that the cradle 2 determines whether the holder 1 is tilted in operation 820, the present disclosure is not limited thereto. In other words, the control unit 120 of the holder 1 may determine whether the holder 1 is tilted.

When the holder 1 is tilted, the method proceeds to operation 840. When the holder 1 is not tilted (i.e., the holder 1 is completely inserted into the cradle 2), the method proceeds to operation 870.

In operation 830, the holder 1 determines whether conditions of using the holder 1 are satisfied. For example, the control unit 120 may determine whether the conditions for using the holder 1 are satisfied by checking whether the remaining power of the battery 110 and whether other components of the holder 1 may be normally operated.

When the conditions for using the holder 1 are satisfied, the method proceeds to operation 840. Otherwise, the method is terminated.

In operation 840, the holder 1 informs a user that the holder 1 is ready to be used. For example, the control unit 120 may output an image indicating that the holder 1 is ready to be used on the display of the holder 1 or may control the motor of the holder 1 to generate a vibration signal.

In operation 850, the heater 130 is heated. For example, when the holder 1 is separated from the cradle 2, the heater 130 may be heated by power of the battery 110 of the holder 1. In another example, when the holder 1 is tilted, the heater 130 may be heated by power of the battery 210 of the cradle 2.

The control unit 120 of the holder 1 or the control unit 220 of the cradle 2 may check the temperature of the heater 130 in real time and control an amount of power supplied to the heater 130 and a time for supplying the power to the heater 130. For example, the control unit 120 or 220 may check the temperature of the heater 130 in real time through a temperature sensor included in the holder 1 or an electrically conductive track of the heater 130.

In operation 860, the holder 1 performs an aerosol generation mechanism. For example, the control unit 120, 220 may check the temperature of the heater 130, which changes as a user performs puffs, and adjust an amount of power supplied to the heater 130 or stop supplying power to the heater 130. Also, the control unit 120 or 220 may count the number of puffs of the user and output information indicating that the holder 1 needs to be cleaned when the number of puffs reaches a certain number of times (e.g., 1500).

In operation 870, the cradle 2 performs charging of the holder 1. For example, the control unit 220 may charge the holder 1 by supplying power of the battery 210 of the cradle 2 to the battery 110 of the holder 1.

Meanwhile, the control unit 120 or 220 may stop the operation of the holder 1 according to the number of puffs of the user or the operation time of the holder 1. Hereinafter, an example in which the control unit 120 or 220 stops the operation of the holder 1 will be described with reference to FIG. 16.

Figure 16:
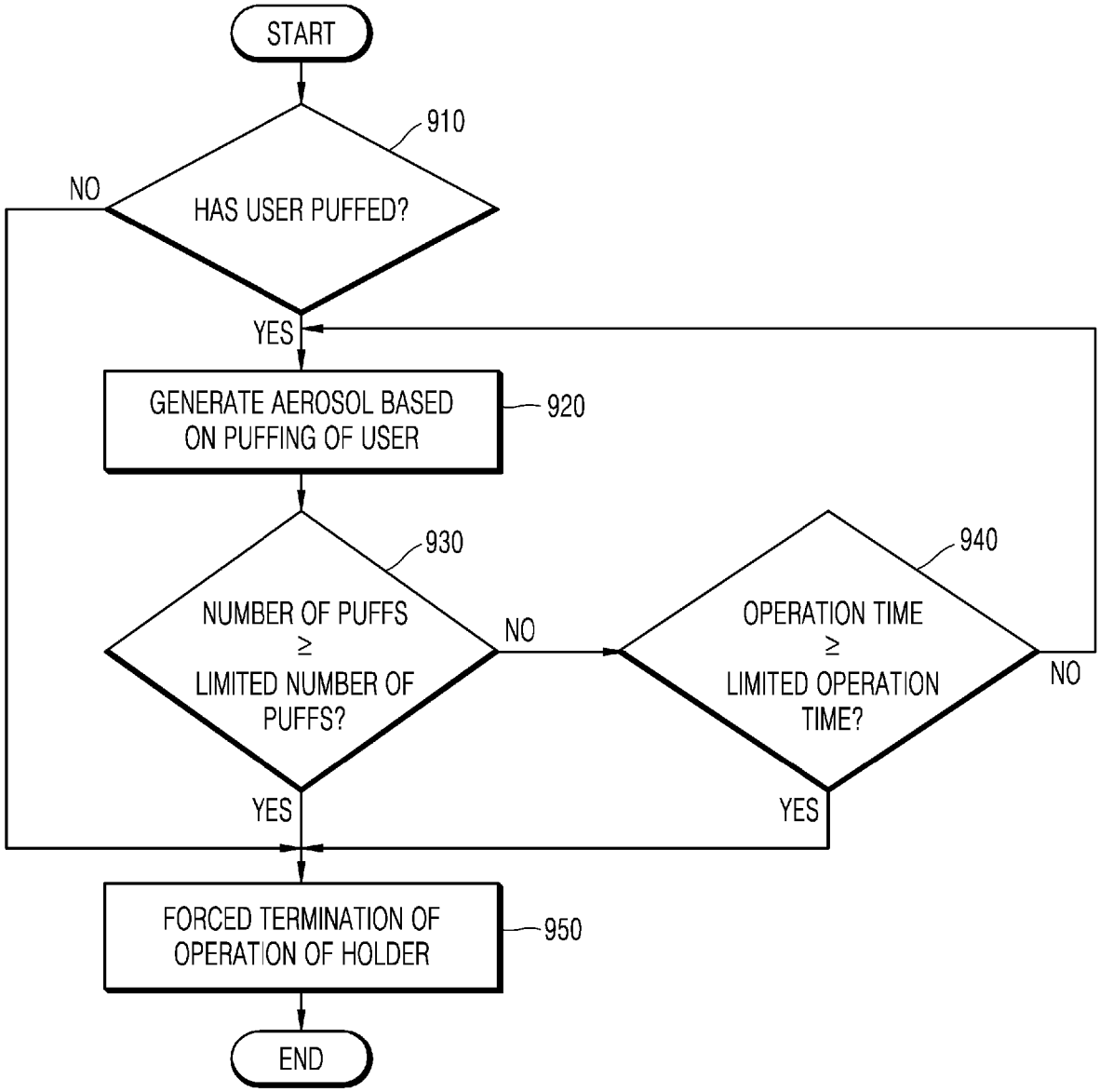
FIG. 16 is a flowchart for describing another example in which a holder operates.

FIG. 16 is a flowchart for describing another example in which a holder operates.

A method for generating aerosols shown in FIG. 16 includes operations that are performed in a time-series manner by the holder 1 shown in FIG. 8 and the cradle 2 shown in FIG. 10. Therefore, it will be understood that the descriptions given above with respect to the holder 1 shown in FIG. 8 or the cradle 2 shown in FIG. 10 also apply to the method of FIG. 16, even when the descriptions are omitted below.

In operation 910, the control unit 120 or 220 determines whether a user puffed. For example, the control unit 120 or 220 may determine whether the user puffed through the puff detecting sensor included in the holder 1.

In operation 920, aerosol is generated according to the puff of the user. The control unit 120 or 220 may adjust power supplied to the heater 130 according to the puff of the user and the temperature of the heater 130, as described above with reference to FIG. 15. Also, the control unit 120 or 220 counts the number of puffs of the user.

In operation 930, the control unit 120 or 220 determines whether the number of puffs of the user is equal to or greater than a puff limit number. For example, assuming that the puff limit number is set to 14, the control unit 120 or 220 determines whether the number of counted puffs is 14 or more.

On the other hand, when the number of puffs of the user is close to the puff limit number (e.g., when the number of puffs of the user is 12), the control unit 120 or 220 may output a warning signal through a display or a vibration motor.

When the number of puffs of the user is equal to or greater than the puff limit number, the method proceeds to operation 950. When the number of puffs of the user is less than the puff limit number, the method proceeds to operation 940.

In operation 940, the control unit 120 or 220 determines whether the operation time of the holder 1 is equal to or greater than an operation limit time. Here, the operation time of the holder 1 refers to accumulated time from a time point aw thich the holder 1 started its operation to a current time point. For example, assuming that the operation limit time is set to 10 minutes, the control unit 120 or 220 determines whether the holder 1 is operating for 10 minutes or longer.

On the other hand, when the operation time of the holder 1 is close to the operation limit time (e.g., when the holder 1 is operating for 8 minutes), the control unit 120 or 220 may output a warning signal through a display or a vibration motor.

When the holder 1 is operating for the operation limit time or longer, the method proceeds to operation 950. When the operation time of the holder 1 is less than the operation limit time, the method proceeds to operation 920.

In operation 950, the control unit 120 or 220 forcibly terminates the operation of the holder 1. In other words, the control unit 120 or 220 terminates the aerosol generation mechanism of the holder 1. For example, the control unit 120 or 220 may forcibly terminate the operation of the holder 1 by interrupting the power supplied to the heater 130.

Figure 17:
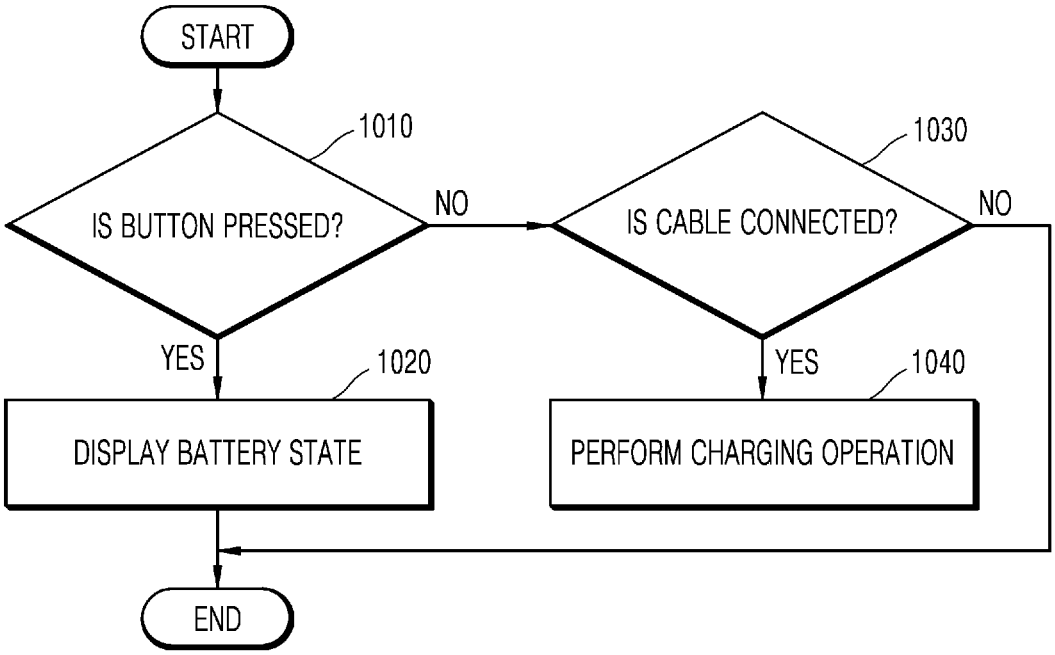
FIG. 17 is a flowchart for describing an example in which a cradle operates.

FIG. 17 is a flowchart for describing an example in which a cradle operates.

The flowchart shown in FIG. 17 includes operations that are performed in a time-series manner by the cradle 2 shown in FIG. 10. Therefore, it will be understood that the descriptions given above with respect to the cradle 2 shown in FIG. 10 also apply to the method of FIG. 17, even when the descriptions are omitted below.

Although not shown in FIG. 17, the operation of the cradle 2 to be described below may be performed regardless of whether the holder 1 is inserted into the cradle 2.

In operation 1010, the control unit 220 of the cradle 2 determines whether the button 240 is pressed. When the button 240 is pressed, the method proceeds to operation 1020. When the button 240 is not pressed, the method proceeds to operation 1030.

In operation 1020, the cradle 2 indicates the status of the battery 210. For example, the control unit 220 may output information regarding the current state of the battery 210 (e.g., remaining power, etc.) on the display 250.

In operation 1030, the control unit 220 of the cradle 2 determines whether a cable is connected to the cradle 2. For example, the control unit 220 determines whether a cable is connected to an interface (e.g., a USB port, etc.) included in the cradle 2. When a cable is connected to the cradle 2, the method proceeds to operation 1040. Otherwise, the method is terminated.

In operation 1040, the cradle 2 performs a charging operation. For example, the cradle 2 charges the battery 210 by using power supplied through a connected cable.

As described above with reference to FIG. 8, a cigarette may be inserted into the holder 1. The cigarette includes an aerosol generating material and aerosol is generated by the heated heater 130.

Hereinafter, an example of a cigarette that may be inserted into the holder 1 will be described with reference to FIGS. 18 to 20F.

Figure 18:
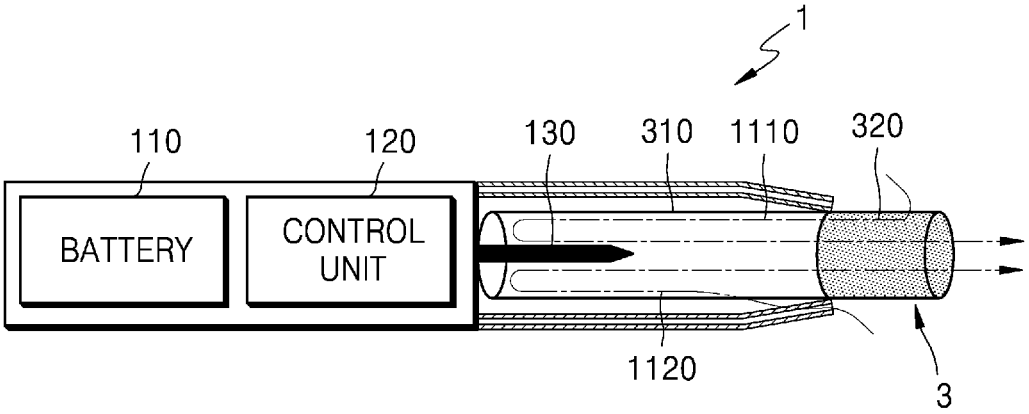
FIG. 18 is a diagram showing an example in which a cigarette is inserted into a holder.

FIG. 18 is a diagram showing an example in which a cigarette is inserted into a holder.

Referring to FIG. 18, the cigarette 3 may be inserted into the holder 1 through the terminal end 141 of the casing 140. When the cigarette 3 is inserted into the holder 1, the heater 130 is located inside the cigarette 3. Therefore, the heated heater 130 heats the aerosol generating material of the cigarette 3, thereby generating aerosol.

The cigarette 3 may be similar to a typical burning cigarette. For example, the cigarette 3 may include a first portion 310 containing an aerosol generating material and a second portion 320 including a filter and the like. Meanwhile, the cigarette 3 according to one embodiment may also include an aerosol generating material in the second portion 320. For example, an aerosol generating material in the form of granules or capsules may be inserted into the second portion 320.

The entire first portion 310 may be inserted into the holder 1 and the second portion 320 may be exposed to the outside. Alternatively, only a portion of the first portion 310 may be inserted into the holder 1 or the entire first portion 310 and a portion the second portion 320 may be inserted into the holder 1.

A user may inhale the aerosol while holding the second portion 320 by his/her lips. At this time, the aerosol is mixed with the outside air and is delivered to a user's mouth. As shown in FIG. 18, the outside air may be introduced (1110) through at least one hole formed in a surface of the cigarette 3, or introduced (1120) through at least one air passage formed in the holder 1. For example, the opening and closing of the air passage formed in the holder 1 may be adjusted by a user.

Figure 19A:
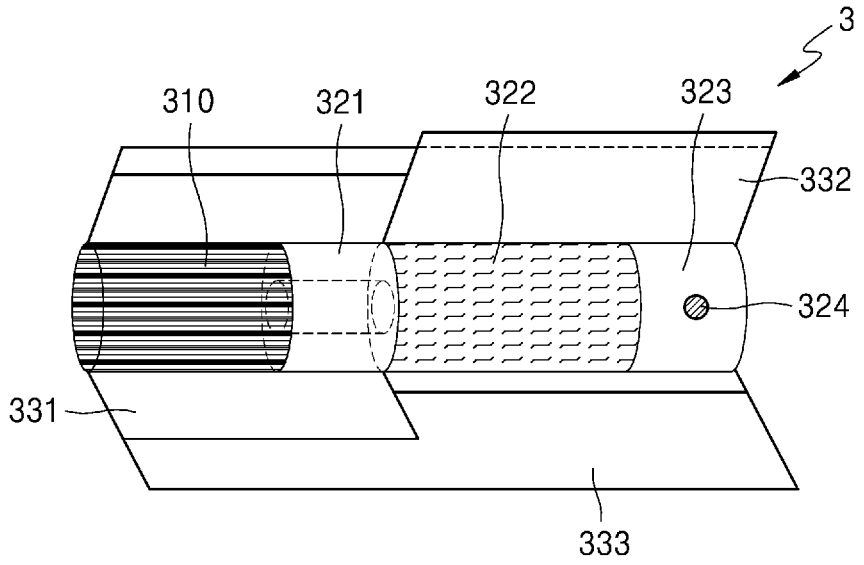
FIGS. 19A and 19B are block diagrams showing examples of a cigarette.
Figure 19B:
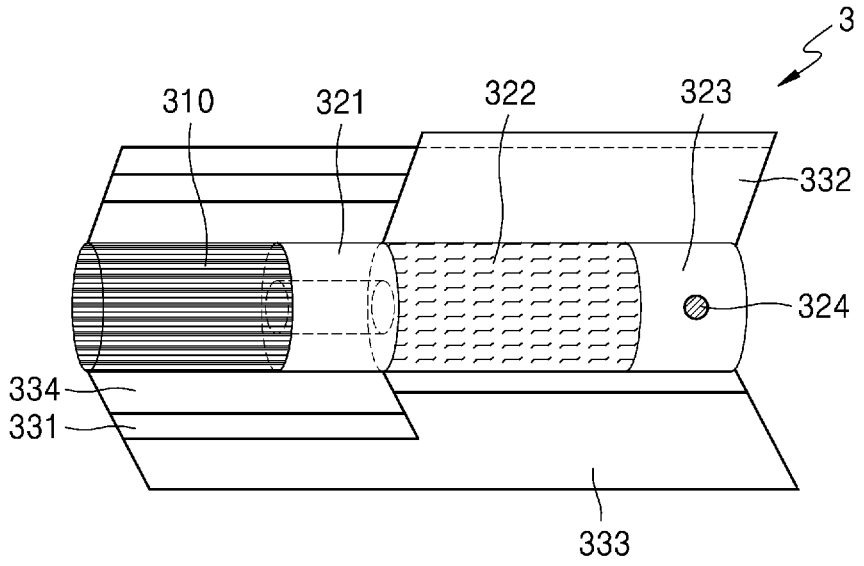

FIGS. 19A and 19B are block diagrams showing examples of a cigarette.

Referring to FIGS. 19A and 19B, the cigarette 3 includes a tobacco rod 310, a first filter segment 321, a cooling structure 322, and a second filter segment 323. The first portion 310 described above with reference to FIG. 18 includes the tobacco rod 310 and the second portion 320 includes the first filter segment 321, the cooling structure 322, and the second filter segment 323.

Meanwhile, referring to FIGS. 19A and 19B, the cigarette 3 shown in FIG. 19B further includes a fourth wrapper 334 compared to the cigarette 3 shown in FIG. 19A.

But, the features of cigarette 3 shown in FIGS. 19A and 19B are examples with some elements omitted. For example, the cigarette 3 may not include one or more of the first filter segment 321, the cooling structure 322, and the second filter segment 323.

The tobacco rod 310 includes an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol. The tobacco rod 310 may have a length ranged between 7 mm to 15 mm, preferably about 12 mm. Also, the tobacco rod 310 may have a diameter ranged between 7 mm to 9 mm, preferably about 7.9 mm. The length and diameter of tobacco rod 310 are not limited to the above range.

Also, the tobacco rod 310 may include other additive materials like a flavoring agent, a wetting agent, and/or acetate compound. For example, the flavoring agent may include licorice, sucrose, fructose syrup, isosweet, cocoa, lavender, cinnamon, cardamom, celery, fenugreek, cascara, sandalwood, bergamot, geranium, honey essence, rose oil, vanilla, lemon oil, orange oil, mint oil, cinnamon, keragene, cognac, jasmine, chamomile, menthol, cinnamon, ylang ylang, salvia, spearmint, ginger, coriander, coffee, etc. In addition, the wetting agent may include glycerin or propylene glycol.

For example, the tobacco rod 310 may be filled with cut tobacco leaves. Here, cut tobacco leaves may be formed by fine-cutting a tobacco sheet.

For a large wide tobacco sheet to be filled within the tobacco rod 310 having a narrow space, a special operation for facilitating folding of the tobacco sheet is further needed. Therefore, it is easier to fill the tobacco rod 310 with cut tobacco leaves compared to filling the tobacco rod 310 with a tobacco sheet, and thus the productivity and the efficiency of the process for producing the tobacco rod 310 may be improved.

In another example, the tobacco rod 310 may be filled with a plurality of cigarette strands formed by fine-cutting a tobacco sheet. For example, the tobacco rod 310 may be formed by combining a plurality of tobacco strands in the same direction (parallel to one another) or randomly. One tobacco strand may be formed into a cuboid shape with 1 mm width, 12 mm depth, and 0.1 mm height, but not limited thereto.

The tobacco rod 310 filled with tobacco strands may generate much more aerosol than tobacco rod 310 filled with tobacco sheet. By filling the tobacco rod with tobacco strands, wider surface area can be secured compared to using tobacco sheet. A wider surface area indicates that an aerosol generating material has a greater chance of contacting the outside air. Therefore, when the tobacco rod 310 is filled with tobacco strands, the tobacco rod can generate much more aerosol compared to when being filled with tobacco sheet.

Also, when the cigarette 3 is being disengaged from the holder 1, the tobacco rod 310 filled with tobacco strands can be easily pulled out compared to when being filled with tobacco sheet. Compared to tobacco sheet, the tobacco strands experience weaker friction when in contact with the heater 130. Therefore, when the tobacco rod 310 is filled with tobacco strands, the tobacco rod can be more easily removed from the holder 1 compared to when being filled with tobacco sheet.

The tobacco sheet can be formed by pulverizing raw tobacco material into a slurry and drying the slurry. For example, the slurry may contain 15% to 30% aerosol generating material. The raw tobacco material may be tobacco leaf fragments, tobacco stems, and/or fine tobacco powders formed during treatment of tobacco. The tobacco sheet may also include other additives like wood cellulose fibers.

The first filter segment 321 may be a cellulose acetate filter. For example, the first filter segment 321 may have a tubular structure including a hollowness therein. The length of the first filter segment 321 may be any suitable length within the range from 7 mm to 15 mm, preferably about 7 mm, but is not limited thereto. The length of the first filter segment 321 may be smaller than about 7 mm, but the first filter segment preferably should have enough length so that function of at least one of components (such as, cooling element, capsule, acetate filter) may not be damaged. The length of the first filter segment 321 is not limited to the above ranges. Meanwhile, the length of the first filter segment 321 may extended so that whole length of the cigarette 3 can be adjusted based on the length of the first filter segment 321.

The second filter segment 323 may also be a cellulose acetate filter. For example, the second filter segment 323 may be fabricated as a recess filter with a hollow cavity, but is not limited thereto. The length of the second filter segment 323 may be within the range from 5 mm to 15 mm, preferably about 12 mm. The length of the second filter segment 323 is not limited to above range.

Also, the second filter segment 323 may include at least one capsule 324. Here, the capsule 324 may have a structure in which a content liquid containing a flavoring material is wrapped with a film. For example, the capsule 324 may have a spherical or cylindrical shape. The capsule 324 may have a diameter equal to or greater than 2 mm, preferably ranged between 2-4 mm.

A material forming a surface of the capsule 324 may be starch and/or gellant. For example, the gallant may include gelatin, or a gum. Also, a gelling agent may be further used as a material for forming the film of the capsule 324. Here, gelling agent may include, for example, a calcium chloride. Furthermore, a plasticizer may be further used as a material for forming the film of the capsule 324. As the plasticizer, glycerin and/or sorbitol may be used. Furthermore, a coloring agent may be further used as a material for forming the film of the capsule 324.

For example, as a flavoring material included in the content liquid of the capsule 324, menthol, plant essential oil, and the like may be used. As a solvent of the flavoring material included in the content liquid, for example, a medium chain fatty acid triglyceride (MCT) may be used. Also, the content liquid may include other additives like a figment, an emulsifying agent, a thickening agent, etc.

The cooling structure 322 cools aerosol generated as the heater 130 heats the tobacco rod 310. Therefore, a user may inhale aerosol cooled to a suitable temperature. The length of the cooling structure 322 may be ranged between about 10 mm to 20 mm, preferably about 14 mm. The length of the cooling structure 322 is not limited to the above range.

For example, the cooling structure 322 may be formed by polylactic acid. The cooling structure 322 may be fabricated into various shapes in order to increase a surface area per unit area, namely, a surface area contacting with aerosol. Hereinafter, Various examples of the cooling structure 322 will be explained referring to FIGS. 210 to 20F.

The tobacco rod 310 and the first filter segment 321 are packed by a first wrapper 331. For example, the first wrapper 331 may be made of an oil-resistant paper sheet.

The cooling structure 322 and the second filter segment 323 are packed by a second wrapper 332. Also, a whole part of cigarette 3 is packaged again by a third wrapper 333. For example, the second wrapper 332 and the third wrapper 333 may be fabricated using a general filter wrapping paper. Alternatively, the second wrapper 332 may be a hard wrapping paper or PLA scented paper. Also, the second wrapper 332 may package a part of the second filter segment 323, and additionally package other part of the second filter segment 323 and the cooling structure 322.

Referring to FIG. 19B, the cigarette 3 may include a fourth wrapper 334. At least one of the cigarette rod 310, the first filter segment 321 may be packaged by the fourth wrapper 334. In other words, only the cigarette rod 310 may be packaged by the fourth wrapper 334, or the cigarette rod 310 and the first filter segment 321 are packaged together by the fourth wrapper 334. For example, the fourth wrapper 334 may be made of wrapping paper.

The fourth wrapper 334 may be formed by depositing or coating a predetermined material on one surface or both surfaces of wrapping paper. Here, an example of the predetermined material may be, but is not limited to, silicon. Silicon exhibits characteristics like heat resistance with little change due to the temperature, oxidation resistance, resistances to various chemicals, water repellency, electrical insulation, etc. However, any material other than silicon may be applied to (or coated on) the fourth wrapper 334.

Meanwhile, although FIG. 19B shows that the cigarette 3 includes both the first wrapper 331 and the fourth wrapper 334, but the embodiment is not limited thereto. In other words, the cigarette 3 may include only one of the first wrapper 331 and the fourth wrapper 334.

The fourth wrapper 334 may prevent the cigarette 3 from being burned. For example, when the tobacco rod 310 is heated by the heater 130, there is a possibility that the cigarette 3 is burned. In detail, when the temperature is raised to a temperature above the ignition point of any one of materials included in the tobacco rod 310, the cigarette 3 may be burned. Even in this case, since the fourth wrapper 334 includes a non-combustible material, the burning of the cigarette 3 may be prevented.

Furthermore, the fourth wrapper 334 may prevent the holder 1 from being contaminated by substances formed by the cigarette 3. Through puffs of a user, liquid substances may be formed in the cigarette 3. For example, as the aerosol formed by the cigarette 3 is cooled by the outside air, liquid materials (e.g., moisture, etc.) may be formed. As the fourth wrapper 334 wraps the tobacco rod 310 and/or the first filter segment 321, the liquid materials formed in the cigarette 3 may be prevented from being leaked out of the cigarette 3. Accordingly, the casing 140 of the holder 1 and the like may be prevented from being contaminated by the liquid materials formed by the cigarette 3.

FIGS. 20A through 20F are views showing examples of a cooling structure of a cigarette.

For example, the cooling structure illustrated in FIGS. 20A through 20F may be manufactured by using fibers including a pure polylactic acid (PLA).

For example, when the cooling structure is manufactured by charging a film (sheet), the film (sheet) may be broken due to external shocks. In this case, the effect of the cooling structure of cooling an aerosol may be reduced.

As another example, when the cooling structure is manufactured by using extrusion molding, etc., a process, such as cutting of the structure, or the like, is added, and thus, the process efficiency may be reduced. Also, there may be a limit for manufacturing the cooling structure to have various forms.

According to an embodiment, when the cooling structure is manufactured (for example, fabricated) by using polylactic acid fibers, the danger of deformation or loss of functions of the cooling structure due to external shocks may be reduced. Also, cooling structures having various forms may be manufactured by changing ways of combining the fibers.

Also, when the cooling structure is manufactured by using the fibers, a surface area contacting an aerosol may be increased. Thus, the aerosol cooling effect of the cooling structure may further be improved.

Figure 20A:
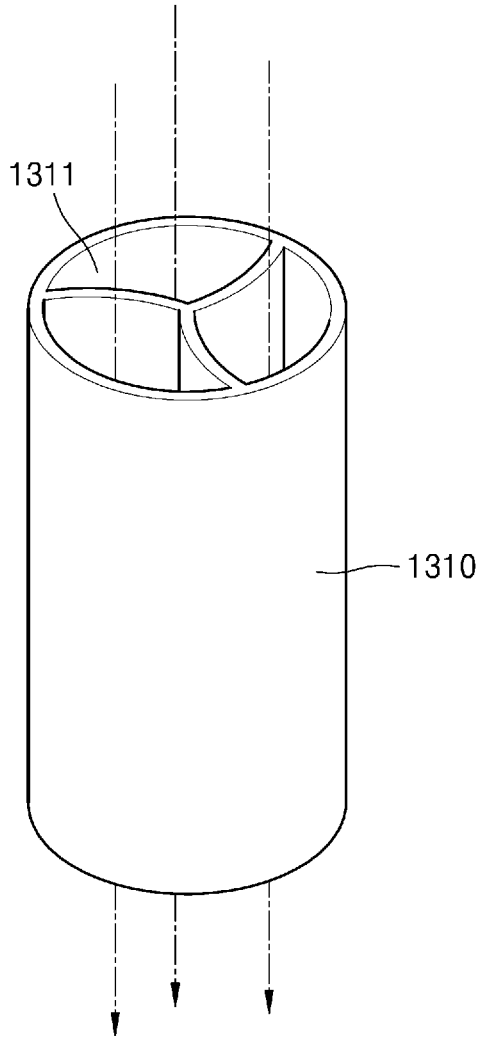
FIGS. 20A through 20F are views illustrating a variety of cooling structures of a cigarette according to different embodiments.

Referring to FIG. 20A, a cooling structure 1310 may be manufactured to have a cylindrical shape and at least one air passage 1311 may be formed at a cross-section of the cooling structure 1310.

Figure 20B:
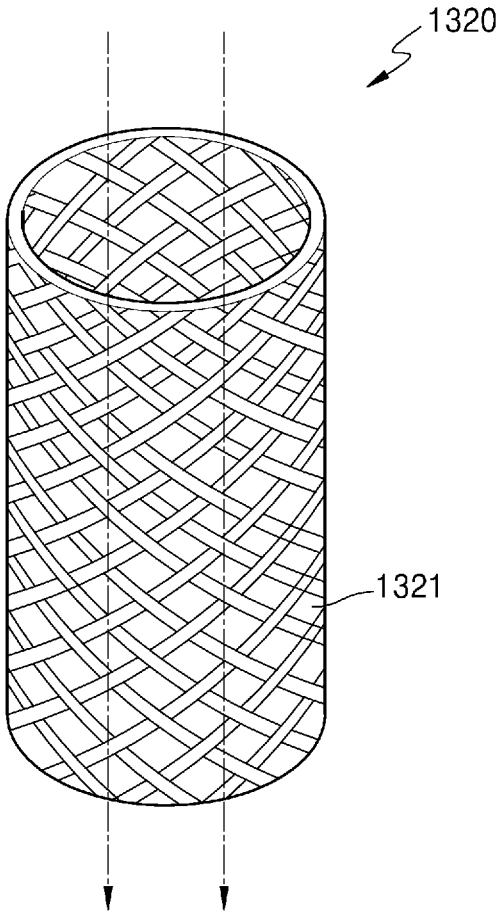

Referring to FIG. 20B, a cooling structure 1320 may be manufactured as a structure in which a plurality of fibers are tangled. Here, an aerosol may flow among the fibers and a vortex may be generated depending on a shape of the cooling structure 1320. The generated vortex may increase an area in which the aerosol contacts the cooling structure 1320 and may increase a time during which the aerosol stays in the cooling structure 1320. Thus, the heated aerosol may be effectively cooled.

Figure 20C:
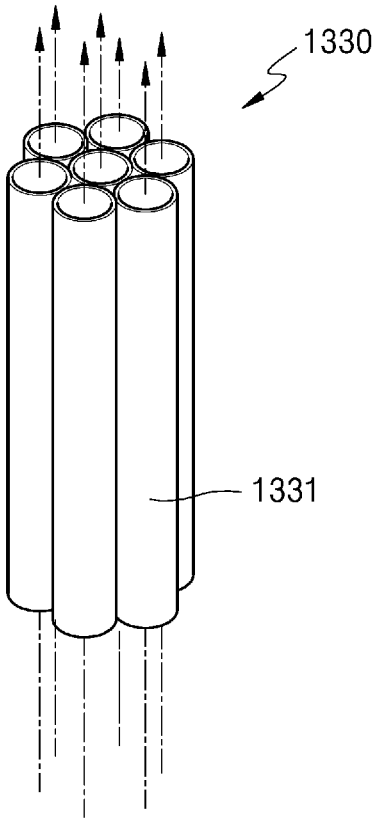

Referring to FIG. 20C, a cooling structure 1330 may be formed in a shape of a plurality of bundles 1331 which are gathered.

Figure 20D:
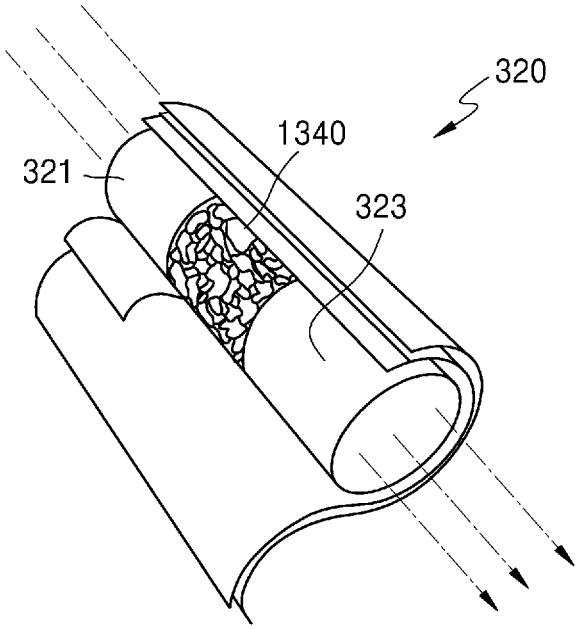

Referring to FIG. 20D, a cooling structure 1340 may be filled with granules including polylactic acid, cut leaves, or charcoal. Also, the granules may include a mixture of polylactic acid, cut leaves, and charcoal. On the other hand, the granules may further include a component capable of increasing the aerosol cooling effect other than polylactic acid, cut leaves, and/or charcoal.

Figure 20E:
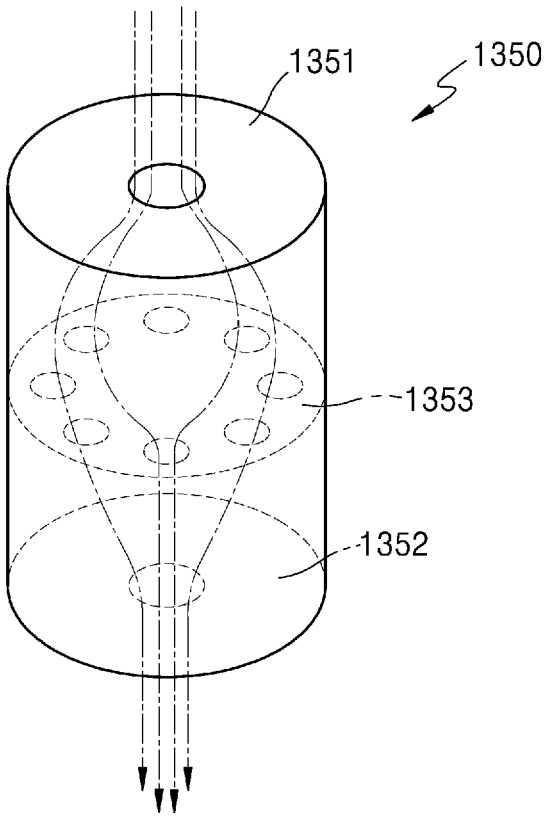

Referring to FIG. 20E, a cooling structure 1350 may include a first cross-section 1351 and a second cross-section 1352.

The first cross-section 1351 may border on a first filter segment 321 and may include a gap through which the aerosol is introduced. The second cross-section 1352 may border on a second filter segment 323 and may include a gap through which the aerosol is discharged. For example, the first cross-section 1351 and the second cross-section 1352 may have a uniform gap having a uniform diameter. However, the diameter of the gap or the number of gaps included in the first cross-section 1351 and the second cross-section 1352 are not limited thereto.

In addition, the cooling structure 1350 may further include, between the first and second cross-sections 1351 and 1352, a third cross-section 1353 including a plurality of gaps. For example, diameters of the plurality of gaps included in the third cross-section 1353 may be less than the diameters of the gaps included in the first cross-section 1351 and the second cross-section 1352. Also, the number of gaps included in the third cross-section 1353 may be greater than the number of gaps included in the first cross-section 1351 and the second cross-section 1352.

Figure 20F:
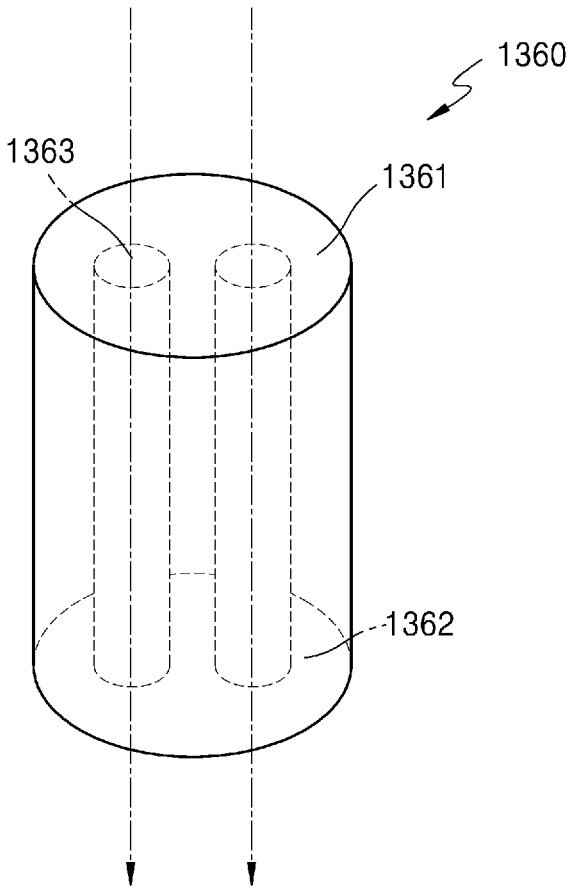

Referring to FIG. 20F, a cooling structure 1360 may include a first cross-section 1361 bordering on the first filter segment 321 and a second cross-section 1362 bordering on the second filter segment 323. Also, the cooling structure 1360 may include at least one tubular element 1363. For example, the tubular element 1363 may pass through the first cross-section 1361 and the second cross-section 1362. Also, the tubular element 1363 may be packaged by using a fine porous packaging material and may be filled with a filling material (for example, the granules described above with reference to FIG. 20D) capable of increasing the aerosol cooling effect.

As described above, the holder may heat the cigarette to generate the aerosol. Also, the holder may independently generate the aerosol or may generate the aerosol in a state in which the holder is inserted into a cradle and tilted. In particular, when the holder is tilted, the heater may be heated by using power of a battery of the cradle.

The described method may be implemented by a general-purpose digital computer operating the program by using a computer-readable recording medium having recorded thereon a program to be executed on a computer. Also, the structure of the data used in the described method may be recorded in the computer-readable recording medium by using various devices. The computer-readable recording medium may include a storage medium, such as a magnetic storage medium (for example, ROM, RAM, USB, floppy disk, hard disk, etc.), or an optical reading medium (for example, CD-ROM, DVD, etc.).

One of ordinary skill in the art should understand that embodiments of the disclosure may be realized in modified forms in a scope within the intrinsic concept of the description. Therefore, it will be understood by one of ordinary skill in the art that the embodiments should be considered in a descriptive sense only and not for purposes of limitation. The scope of the disclosure is defined not by the detailed description of the disclosure but by the appended claims, and all differences within the scope will be construed as being included in the disclosure.

INDUSTRIAL APPLICABILITY

Embodiments may be applied to a heated cigarette, a heated aerosol generating device, etc.

What is claimed is:

1. An aerosol generating device comprising:

a case;

a container mounted inside the case, configured to move in a longitudinal direction of the case, and having an accommodating space configured to accommodate a cigarette;

a heater disposed inside the case such that a front end thereof is inserted into the accommodating space of the container, and configured to heat the cigarette when electricity is applied thereto; and an elastic support portion configured to elastically support the container with respect to the case such that a restoring force of the elastic support portion acts to push the container away from the heater.

2. The aerosol generating device of claim 1, wherein the case includes a guide space configured to guide the container to move linearly.

3. The aerosol generating device of claim 1, wherein the container further includes a through-hole through which the front end of the heater passes.

4. The aerosol generating device of claim 3, wherein a size of the through-hole corresponds to a thickness of the front end of the heater, and while the container moves, a portion of the container corresponding to the through-hole contacts the heater, and scrapes a material attached to a surface of the heater.

5. The aerosol generating device of claim 4, wherein a coating layer including a wear-resistant material is provided on a surface of a front end of the heater.

6. The aerosol generating device of claim 3, wherein a size of the through-hole is greater than a size of the front end of the heater such that a portion of the container corresponding to the through-hole is spaced apart from the front end of the heater.

7. The aerosol generating device of claim 1, further comprising a fixing portion coupled to a rear end of the heater and configured to fix a position of the heater with respect to the case, wherein the elastic support portion is disposed between the fixing portion and the container.

8. The aerosol generating device of claim 7, wherein the container includes an expansion portion corresponding to an end of the container having an extended inner diameter, and the case includes an insertion portion configured to extend in a direction in which the container moves, and disposed between an inner wall surface of the expansion portion of the container and an outer circumferential surface of the cigarette.

9. The aerosol generating device of claim 8, wherein the container includes a stepped portion formed on an outer surface of the expansion portion, and the elastic support portion is disposed between the stepped portion and the fixing portion.

10. The aerosol generating device of claim 1, further comprising a stopper disposed between the container and the case and configured to apply resistance force in a direction opposite to a direction in which the container moves.

* * * * *